US008045572B1

(12) United States Patent
Li et al.

(10) Patent No.: US 8,045,572 B1
(45) Date of Patent: Oct. 25, 2011

(54) ADAPTIVE JITTER BUFFER-PACKET LOSS CONCEALMENT

(75) Inventors: Hongxin Li, Shanghai (CN); Li Xu, Shanghai (CN)

(73) Assignee: Marvell International Ltd., Hamilton (BM)

( * ) Notice: Subject to any disclaimer, the term of this patent is extended or adjusted under 35 U.S.C. 154(b) by 791 days.

(21) Appl. No.: 12/152,532

(22) Filed: May 15, 2008

Related U.S. Application Data

(63) Continuation of application No. 12/029,853, filed on Feb. 12, 2008, now Pat. No. 7,873,064.

(60) Provisional application No. 60/889,456, filed on Feb. 12, 2007.

(51) Int. Cl.
*G10L 11/00* (2006.01)

(52) U.S. Cl. ..... 370/419; 704/200

(58) Field of Classification Search ..... None
See application file for complete search history.

(56) References Cited

U.S. PATENT DOCUMENTS

| | | | | |
|---|---|---|---|---|
| 6,504,838 | B1 | 1/2003 | Kwan | |
| 6,584,438 | B1 * | 6/2003 | Manjunath et al. | 704/228 |
| 6,614,370 | B2 | 9/2003 | Gottesman | |
| 6,691,082 | B1 * | 2/2004 | Aguilar et al. | 704/219 |
| 6,721,707 | B1 | 4/2004 | Chu et al. | |
| 6,847,618 | B2 | 1/2005 | Laursen et al. | |
| 6,973,425 | B1 * | 12/2005 | Kapilow | 704/228 |
| 7,047,190 | B1 * | 5/2006 | Kapilow | 704/228 |
| 7,117,156 | B1 * | 10/2006 | Kapilow | 704/267 |
| 7,130,316 | B2 | 10/2006 | Kovacevic | |
| 7,233,897 | B2 * | 6/2007 | Kapilow | 704/229 |
| 7,302,385 | B2 * | 11/2007 | Sung et al. | 704/219 |
| 7,337,108 | B2 * | 2/2008 | Florencio et al. | 704/208 |
| 7,711,554 | B2 * | 5/2010 | Mori et al. | 704/211 |
| 2006/0164927 | A1 | 7/2006 | Kato et al. | |
| 2007/0061137 | A1 | 3/2007 | Yang et al. | |
| 2007/0088542 | A1 * | 4/2007 | Vos et al. | 704/219 |
| 2008/0046235 | A1 * | 2/2008 | Chen | 704/228 |

OTHER PUBLICATIONS

GIPS VoiceEngineTM Embedded for IP Phones; Global IP Solutions, Inc.; www.gipscorp.com; Mar. 13, 2007; 2 pages.

The Impact of Adaptive Playout Buffer Algorithm on Perceived Speech Quality Transported Over IP Networks; Pin Hu; Master's Thesis at the University of Plymouth; Sep. 2003; 93 pages.

VOIP Packet Loss Concealment Based on Two-Side Pitch Waveform Replication Technique Using Steganography; Naofumi Aoki; Graduate School of Information Science and Technology, Hokkaido University N14 W9, Kita-ku, Sapporo, 060-0814 Japan; pp. 52-55.

* cited by examiner

*Primary Examiner* — Kwang B Yao
*Assistant Examiner* — Alex Skripnikov

(57) ABSTRACT

A packet loss concealment system includes first and second buffers that stores audio samples prior to and subsequent to a missing section of audio samples. A forward propagation module generates a forward propagated waveform by propagating a first waveform period that is based on the first buffer. The forward propagation module increases periodicity of the first waveform period nonlinearly when propagating the first waveform period. A backward propagation module generates a backward propagated waveform by propagating a second waveform period that is based on the second buffer. A ratio control module selectively determines a ratio between a first periodicity of the audio samples in the second buffer and a second periodicity of the audio samples in the first buffer. The forward propagation module selectively propagates the first waveform period using the ratio, and the backward propagation module selectively propagates the second waveform period using an inverse of the ratio.

50 Claims, 18 Drawing Sheets

ADAPTIVE JITTER BUFFER-PACKET LOSS CONCEALMENT

CROSS-REFERENCE TO RELATED APPLICATIONS

This application is a continuation of U.S. patent application Ser. No. 12/029,853, filed Feb. 12, 2008, which claims the benefit of U.S. Provisional Application No. 60/889,456, filed on Feb. 12, 2007, the disclosures of which are incorporated herein by reference in their entirety.

FIELD

The present disclosure relates to network-based telephony, and more particularly to jitter buffering and packet loss concealment.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Referring now to FIG. 1, a functional block diagram of a Voice over Internet Protocol (VoIP) phone 100 is presented. The VoIP phone 100 includes a network interface 102, which may be wireless and/or wired. Packets received by the network interface 102 are passed to a buffer 104. Because the packets are arriving over a dynamic network, the packets may arrive out of order. The buffer 104 buffers packets and reorders them.

The delay in receiving each packet may also vary. The buffer 104 may store a number of packets so that packets can continue to be extracted from the buffer 104 while waiting for delayed packets from the network interface 102. This creates a buffering delay, which may be distracting to a user of the VoIP phone 100.

In order to prevent the buffer 104 from running out of packets, the delay built into the buffer 104 is created to be as long as the greatest expected difference in transmission times between two packets. For example, if all packets arriving over the network are received at least 100 ms after they are transmitted, there is a network delay of 100 ms. If some packets take as much as 300 ms to arrive, an additional 200 ms of delay may be built into the buffer 104. In this way, the buffer 104 will not empty even if a packet is received 300 ms after it is transmitted. The difference between packet delay times is referred to as jitter. A larger amount of jitter is addressed by a longer delay in the buffer 104.

Some packets may never be received by the network interface 102. These lost packets may result in degradation of the sound quality of the received data. Further, some packets may arrive after the longest expected delay. These packets may arrive so late that subsequent packets have already arrived and have been processed. Late arriving packets may therefore present the same quality problems as packets that are lost completely. A decoder 106 may implement Packet Loss Concealment (PLC) to help mask the effects of lost packets.

Packets are output from the buffer 104 to the decoder 106. The decoder 106 may be a speech decoder, and may include an implementation of a standard such as International Telecommunications Union Telecommunications Standardization Sector (ITU-T) G.711 and/or ITU-T G.729. Decoded audio is output from the decoder 106 to an acoustic echo control module 108.

The acoustic echo control module 108 may remove acoustic echo and/or add a sidetone from a microphone 110 onto the decoded audio. The acoustic echo control module 108 then outputs audio data to a speaker 112. The acoustic echo control module 108 receives audio data from the microphone 110. The acoustic echo control module 108 may reduce echo between the speaker 112 and the microphone 110, and outputs audio data to a noise suppression module 114.

The noise suppression module 114 suppresses noise and outputs the resulting audio data to an encoder 116. The encoder 116 encodes the data and outputs encoded data to the network interface 102. The encoded speech may be transmitted and received over the network using a transport protocol, such as the Real Time Transport Protocol (RTP).

SUMMARY

An audio decoding system comprises a buffer module, an audio decoding module, a packet loss concealment module, an uncompressed adjustment module, and a playout control module. The buffer module receives packets including audio data. The audio decoding module decodes the audio data and outputs decoded audio samples. The packet loss concealment module outputs adjusted audio samples based on the decoded audio samples. The adjusted audio samples include reconstructed samples when packet loss occurs. The uncompressed adjustment module incorporates the adjusted audio samples into an output stream of audio samples at a first rate. The playout control module regulates the first rate based on packet delay information.

In other features, the decoded audio samples, the adjusted audio samples, and the output stream of output samples comprise pulse-code modulation (PCM) samples. The playout control module determines a target playout time based on the packet delay information and regulates the first rate based on the target playout time. The playout control module increases the target playout time at a first change rate based on an increase in jitter, and decreases the target playout time at a second change rate based on a decrease in the jitter. The first change rate is greater than the second change rate.

In further features, the packet delay information comprises a transmission delay value for each of the packets, and the playout control module determines the jitter based on differences between the transmission delay values of at least two of the packets. The audio decoding system further comprises a silence interval adjust module that, before the audio data is decoded by the audio decoding module, at least one of selectively inserts silent audio frames into the audio data and selectively deletes silent audio frames from the audio data. The playout control module controls the silence interval adjust module based on the target playout time. The silence interval adjust module only inserts the silent audio frames adjacent to existing silent audio frames in the audio data.

In still other features, the playout control module causes the silence interval adjust module to selectively insert the silent audio frames when the target playout time is greater than a threshold, and to selectively delete the silent audio frames when the target playout time is less than the threshold. A number of the silent audio frames being inserted increases as the target playout time increases. A number of the silent audio frames being deleted increases as the target playout time decreases. The output stream is read from the uncompressed adjustment module at a second rate. The playout control module increases the first rate as the target playout time decreases. An audio playback system comprises the audio decoding system and a digital to analog converter that converts the output stream to analog at the second rate.

In other features, the playout control module decreases the first rate as the target playout time increases. The uncompressed adjustment module selectively inserts at least one of waveform periods and individual audio samples into the output stream when the first rate is less than the second rate. The uncompressed adjustment module incorporates all of the adjusted audio samples into the output stream when the first rate is less than or equal to the second rate. The uncompressed adjustment module selectively inserts the waveform periods when the output stream comprises voice data, and selectively inserts the individual audio samples otherwise. The individual audio samples comprise at least one of silent audio samples and white noise samples.

In further features, the output stream comprises voice data when a rate of zero crossings of the output stream is less than a crossing threshold. The uncompressed adjustment module inserts one of the waveform periods between first and second groups of audio samples of the output stream, and generates the one of the waveform periods based on the first and second groups. The uncompressed adjustment module generates the one of the waveform periods by adding the first group multiplied by a first windowing function to the second group multiplied by a second windowing function. The uncompressed adjustment module selectively inserts multiple copies of the one of the waveform periods between the first and second groups.

In still other features, the first and second groups have lengths approximately equal to a length of the one of the waveform periods. The length is determined by a periodicity of the output stream. The uncompressed adjustment module determines the length of the one of the waveform periods by determining a level of periodicity of the output stream for each of a plurality of test periods and selecting one of the plurality of test periods whose level of periodicity is highest. The uncompressed adjustment module determines the level of periodicity corresponding to a first one of the plurality of test periods by performing a correlation between a first group of the audio samples of the output stream and a second group of the audio samples of the output stream.

In other features, the first and second groups are adjacent and have lengths equal to the first one of the plurality of test periods. The uncompressed adjustment module omits inserting the waveform periods when the output stream comprises unstable voice data. The output stream comprises unstable voice data when the highest level of periodicity is below a periodicity threshold. When the first rate is greater than the second rate, the uncompressed adjustment module selectively merges ones of the adjusted audio samples and includes the merged audio samples in the output stream.

In further features, the uncompressed adjustment module merges the ones of the adjusted audio samples when the output stream comprises voice data. The uncompressed adjustment module merges first and second groups of the adjusted audio samples. The first and second groups are adjacent and have a length determined by a periodicity of the adjusted audio samples. The uncompressed adjustment module merges the first and second groups by adding the first group multiplied by a first windowing function to the second group multiplied by a second windowing function. The second rate is approximately constant.

A method of controlling an audio decoding system comprises receiving packets including audio data; decoding the audio data into decoded audio samples; outputting adjusted audio samples based on the decoded audio samples; including reconstructed samples in the adjusted audio samples when packet loss occurs; incorporating the adjusted audio samples into an output stream of audio samples at a first rate; and regulating the first rate based on packet delay information.

The decoded audio samples, the adjusted audio samples, and the output stream of output samples comprise pulse-code modulation (PCM) samples. The method further comprises determining a target playout time based on the packet delay information; and regulating the first rate based on the target playout time. The method further comprises increasing the target playout time at a first change rate based on an increase in jitter; and decreasing the target playout time at a second change rate based on a decrease in the jitter. The first change rate is greater than the second change rate.

In other features, the packet delay information comprises a transmission delay value for each of the packets, and further comprises determining the jitter based on differences between the transmission delay values of at least two of the packets. The method further comprises, before the audio data is decoded at least one of selectively inserting silent audio frames into the audio data and selectively deleting silent audio frames from the audio data; and controlling the inserting and deleting based on the target playout time. The method further comprises inserting the silent audio frames only adjacent to existing silent audio frames in the audio data.

In further features, the method further comprises selectively inserting the silent audio frames when the target playout time is greater than a threshold; selectively deleting the silent audio frames when the target playout time is less than the threshold; increasing a number of the silent audio frames being inserted as the target playout time increases; and increasing a number of the silent audio frames being deleted as the target playout time decreases. The method further comprises reading the output stream at a second rate; and increasing the first rate as the target playout time decreases.

In still other features, the method further comprises converting the output stream to analog at the second rate. The method further comprises decreasing the first rate as the target playout time increases. The method further comprises selectively inserting at least one of waveform periods and individual audio samples into the output stream when the first rate is less than the second rate. The method further comprises incorporating all of the adjusted audio samples into the output stream when the first rate is less than or equal to the second rate. The method further comprises selectively inserting the waveform periods when the output stream comprises voice data; and selectively inserting the individual audio samples when the output stream comprises other than voice data.

In other features, the individual audio samples comprise at least one of silent audio samples and white noise samples. The output stream comprises voice data when a rate of zero crossings of the output stream is less than a crossing threshold. The method further comprises inserting one of the waveform periods between first and second groups of audio samples of the output stream; and generating the one of the waveform periods based on the first and second groups. The method further comprises generating the one of the waveform periods by adding the first group multiplied by a first windowing function to the second group multiplied by a second windowing function.

In further features, the method further comprises selectively inserting multiple copies of the one of the waveform periods between the first and second groups. The first and second groups have lengths approximately equal to a length of the one of the waveform periods. The length is determined by a periodicity of the output stream. The method further comprises determining the length of the one of the waveform periods by determining a level of periodicity of the output stream for each of a plurality of test periods; and selecting one of the plurality of test periods whose level of periodicity is highest.

In still other features, the method further comprises determining the level of periodicity corresponding to a first one of the plurality of test periods by performing a correlation between a first group of the audio samples of the output stream and a second group of the audio samples of the output stream. The first and second groups are adjacent and have lengths equal to the first one of the plurality of test periods. The method further comprises omitting inserting the waveform periods when the output stream comprises unstable voice data. The output stream comprises unstable voice data when the highest level of periodicity is below a periodicity threshold.

In other features, the method further comprises, when the first rate is greater than the second rate selectively merging ones of the adjusted audio samples; and including the merged audio samples in the output stream. The method further comprises merging the ones of the adjusted audio samples when the output stream comprises voice data. The method further comprises merging first and second groups of the adjusted audio samples. The first and second groups are adjacent and have a length determined by a periodicity of the adjusted audio samples. The method further comprises merging the first and second groups by adding the first group multiplied by a first windowing function to the second group multiplied by a second windowing function. The second rate is approximately constant.

A computer program stored on a computer-readable medium for use by a processor for operating an audio decoding system comprises receiving packets including audio data; decoding the audio data into decoded audio samples; outputting adjusted audio samples based on the decoded audio samples; including reconstructed samples in the adjusted audio samples when packet loss occurs; incorporating the adjusted audio samples into an output stream of audio samples at a first rate; and regulating the first rate based on packet delay information.

The decoded audio samples, the adjusted audio samples, and the output stream of output samples comprise pulse-code modulation (PCM) samples. The method further comprises determining a target playout time based on the packet delay information; and regulating the first rate based on the target playout time. The method further comprises increasing the target playout time at a first change rate based on an increase in jitter; and decreasing the target playout time at a second change rate based on a decrease in the jitter. The first change rate is greater than the second change rate.

In other features, the packet delay information comprises a transmission delay value for each of the packets, and further comprises determining the jitter based on differences between the transmission delay values of at least two of the packets. The method further comprises, before the audio data is decoded at least one of selectively inserting silent audio frames into the audio data and selectively deleting silent audio frames from the audio data; and controlling the inserting and deleting based on the target playout time. The method further comprises inserting the silent audio frames only adjacent to existing silent audio' frames in the audio data.

In further features, the method further comprises selectively inserting the silent audio frames when the target playout time is greater than a threshold; selectively deleting the silent audio frames when the target playout time is less than the threshold; increasing a number of the silent audio frames being inserted as the target playout time increases; and increasing a number of the silent audio frames being deleted as the target playout time decreases. The method further comprises reading the output stream at a second rate; and increasing the first rate as the target playout time decreases.

In still other features, the method further comprises converting the output stream to analog at the second rate. The method further comprises decreasing the first rate as the target playout time increases. The method further comprises selectively inserting at least one of waveform periods and individual audio samples into the output stream when the first rate is less than the second rate. The method further comprises incorporating all of the adjusted audio samples into the output stream when the first rate is less than or equal to the second rate. The method further comprises selectively inserting the waveform periods when the output stream comprises voice data; and selectively inserting the individual audio samples when the output stream comprises other than voice data.

In other features, the individual audio samples comprise at least one of silent audio samples and white noise samples. The output stream comprises voice data when a rate of zero crossings of the output stream is less than a crossing threshold. The method further comprises inserting one of the waveform periods between first and second groups of audio samples of the output stream; and generating the one of the waveform periods based on the first and second groups. The method further comprises generating the one of the waveform periods by adding the first group multiplied by a first windowing function to the second group multiplied by a second windowing function.

In further features, the method further comprises selectively inserting multiple copies of the one of the waveform periods between the first and second groups. The first and second groups have lengths approximately equal to a length of the one of the waveform periods. The length is determined by a periodicity of the output stream. The method further comprises determining the length of the one of the waveform periods by determining a level of periodicity of the output stream for each of a plurality of test periods; and selecting one of the plurality of test periods whose level of periodicity is highest.

In still other features, the method further comprises determining the level of periodicity corresponding to a first one of the plurality of test periods by performing a correlation between a first group of the audio samples of the output stream and a second group of the audio samples of the output stream. The first and second groups are adjacent and have lengths equal to the first one of the plurality of test periods. The method further comprises omitting inserting the waveform periods when the output stream comprises unstable voice data. The output stream comprises unstable voice data when the highest level of periodicity is below a periodicity threshold.

In other features, the method further comprises, when the first rate is greater than the second rate selectively merging ones of the adjusted audio samples; and including the merged audio samples in the output stream. The method further comprises merging the ones of the adjusted audio samples when the output stream comprises voice data. The method further comprises merging first and second groups of the adjusted audio samples. The first and second groups are adjacent and have a length determined by a periodicity of the adjusted audio samples. The method further comprises merging the first and second groups by adding the first group multiplied by a first windowing function to the second group multiplied by a second windowing function. The second rate is approximately constant.

An audio decoding system comprises buffer means for receiving packets including audio data; audio decoding means for decoding the audio data and outputting decoded audio samples; packet loss concealing means for outputting adjusted audio samples based on the decoded audio samples, where the adjusted audio samples include reconstructed samples when packet loss occurs; uncompressed adjusting means for incorporating the adjusted audio samples into an output stream of audio samples at a first rate; and playout control means for regulating the first rate based on packet delay information.

In other features, the decoded audio samples, the adjusted audio samples, and the output stream of output samples comprise pulse-code modulation (PCM) samples. The playout control means determines a target playout time based on the packet delay information and regulates the first rate based on the target playout time. The playout control means increases the target playout time at a first change rate based on an increase in jitter, and decreases the target playout time at a second change rate based on a decrease in the jitter. The first change rate is greater than the second change rate.

In further features, the packet delay information comprises a transmission delay value for each of the packets, and the playout control means determines the jitter based on differences between the transmission delay values of at least two of the packets. The audio decoding system further comprises silence interval adjusting means for, before the audio data is decoded by the audio decoding means, at least one of selectively inserting silent audio frames into the audio data and selectively deleting silent audio frames from the audio data. The playout control means controls the silence interval adjusting means based on the target playout time. The silence interval adjusting means only inserts the silent audio frames adjacent to existing silent audio frames in the audio data.

In still other features, the playout control means causes the silence interval adjusting means to selectively insert the silent audio frames when the target playout time is greater than a threshold, and to selectively delete the silent audio frames when the target playout time is less than the threshold. A number of the silent audio frames being inserted increases as the target playout time increases. A number of the silent audio frames being deleted increases as the target playout time decreases. The output stream is read from the uncompressed adjusting means at a second rate. The playout control means increases the first rate as the target playout time decreases. An audio playback system comprises the audio decoding system and digital to analog conversion means for converting the output stream to analog at the second rate.

In other features, the playout control means decreases the first rate as the target playout time increases. The uncompressed adjusting means selectively inserts at least one of waveform periods and individual audio samples into the output stream when the first rate is less than the second rate. The uncompressed adjusting means incorporates all of the adjusted audio samples into the output stream when the first rate is less than or equal to the second rate. The uncompressed adjusting means selectively inserts the waveform periods when the output stream comprises voice data, and selectively inserts the individual audio samples otherwise.

In further features, the individual audio samples comprise at least one of silent audio samples and white noise samples. The output stream comprises voice data when a rate of zero crossings of the output stream is less than a crossing threshold. The uncompressed adjusting means inserts one of the waveform periods between first and second groups of audio samples of the output stream, and generates the one of the waveform periods based on the first and second groups. The uncompressed adjusting means generates the one of the waveform periods by adding the first group multiplied by a first windowing function to the second group multiplied by a second windowing function.

In still other features, the uncompressed adjusting means selectively inserts multiple copies of the one of the waveform periods between the first and second groups. The first and second groups have lengths approximately equal to a length of the one of the waveform periods. The length is determined by a periodicity of the output stream. The uncompressed adjusting means determines the length of the one of the waveform periods by determining a level of periodicity of the output stream for each of a plurality of test periods and selecting one of the plurality of test periods whose level of periodicity is highest.

In other features, the uncompressed adjusting means determines the level of periodicity corresponding to a first one of the plurality of test periods by performing a correlation between a first group of the audio samples of the output stream and a second group of the audio samples of the output stream. The first and second groups are adjacent and have lengths equal to the first one of the plurality of test periods. The uncompressed adjusting means omits inserting the waveform periods when the output stream comprises unstable voice data. The output stream comprises unstable voice data when the highest level of periodicity is below a periodicity threshold. When the first rate is greater than the second rate, the uncompressed adjusting means selectively merges ones of the adjusted audio samples and includes the merged audio samples in the output stream.

In further features, the uncompressed adjusting means merges the ones of the adjusted audio samples when the output stream comprises voice data. The uncompressed adjusting means merges first and second groups of the adjusted audio samples. The first and second groups are adjacent and have a length determined by a periodicity of the adjusted audio samples. The uncompressed adjusting means merges the first and second groups by adding the first group multiplied by a first windowing function to the second group multiplied by a second windowing function. The second rate is approximately constant.

An audio decoding system comprises a buffer module that receives packets including encoded audio frames that each store audio parameters; a packet loss concealment module that selectively extracts the audio parameters from ones of the encoded audio frames, determines recovered audio parameters based on the extracted audio parameters, and encodes the recovered audio parameters into recovered audio frames; and an audio decoding module that decodes the encoded audio frames and the recovered audio frames and outputs decoded audio samples.

The decoded audio samples and the output stream of output samples comprise pulse-code modulation (PCM) samples. The audio decoding system further comprises an uncompressed adjustment module that generates an output stream of audio samples and that incorporates the decoded audio samples into the output stream at a first rate; and a playout control module that determines a target playout time based on packet delay information of the packets and regulates the first rate based on the target playout time. The playout control module increases the target playout time at a first change rate based on an increase in jitter, and decreases the target playout time at a second change rate based on a decrease in the jitter.

In other features, the first change rate is greater than the change second rate. The packet delay information comprises a transmission delay value for each of the packets, and the playout control module determines the jitter based on differences between the transmission delay values of at least two of the packets. The audio decoding system further comprises a silence interval adjust module that, before the audio decoding module decodes the encoded audio frames, at least one of selectively inserts silent encoded audio frames and selectively deletes silent encoded audio frames. The playout control module controls the silence interval adjust module based on the target playout time.

In further features, the silence interval adjust module only inserts the silent encoded audio frames adjacent to existing silent encoded audio frames in the audio data. The playout control module causes the silence interval adjust module to selectively insert the silent encoded audio frames when the target playout time is greater than a threshold, and to selectively delete the silent encoded audio frames when the target playout time is less than the threshold. A number of the silent encoded audio frames being inserted increases as the target playout time increases. A number of the silent encoded audio frames being deleted increases as the target playout time decreases.

In still other features, the audio decoding system further comprises an uncompressed adjustment module that generates an output stream of audio samples and that incorporates the decoded audio samples into the output stream at a first rate; and a playout control module that determines a target playout time based on packet delay information of the packets and that increases the first rate as the target playout time decreases. The output stream is read from the uncompressed adjustment module at a second rate. An audio playback system comprises the audio decoding system and a digital to analog converter that converts the output stream to analog at the second rate.

In other features, the playout control module decreases the first rate as the target playout time increases. The uncompressed adjustment module selectively inserts at least one of waveform periods and individual audio samples into the output stream when the first rate is less than the second rate. The uncompressed adjustment module incorporates all of the decoded audio samples into the output stream when the first rate is less than or equal to the second rate. The uncompressed adjustment module selectively inserts the waveform periods when the output stream comprises voice data, and selectively inserts the individual audio samples otherwise. The individual audio samples comprise at least one of silent audio samples and white noise samples.

In further features, the output stream comprises voice data when a rate of zero crossings of the output stream is less than a crossing threshold. The uncompressed adjustment module inserts one of the waveform periods between first and second groups of audio samples of the output stream, and generates the one of the waveform periods based on the first and second groups. The uncompressed adjustment module generates the one of the waveform periods by adding the first group multiplied by a first windowing function to the second group multiplied by a second windowing function. The uncompressed adjustment module selectively inserts multiple copies of the one of the waveform periods between the first and second groups.

In still other features, the first and second groups have lengths approximately equal to a length of the one of the waveform periods. The length is determined by a periodicity of the output stream. The uncompressed adjustment module determines the length of the one of the waveform periods by determining a level of periodicity of the output stream for each of a plurality of test periods and selecting one of the plurality of test periods whose level of periodicity is highest. The uncompressed adjustment module determines the level of periodicity corresponding to a first one of the plurality of test periods by performing a correlation between a first group of the audio samples of the output stream and a second group of the audio samples of the output stream.

In other features, the first and second groups are adjacent and have lengths equal to the first one of the plurality of test periods. The uncompressed adjustment module omits inserting the waveform periods when the output stream comprises unstable voice data. The output stream comprises unstable voice data when the highest level of periodicity is below a periodicity threshold. When the first rate is greater than the second rate, the uncompressed adjustment module selectively merges ones of the decoded audio samples and includes the merged audio samples in the output stream. The uncompressed adjustment module merges the ones of the decoded audio samples when the output stream comprises voice data.

In further features, the uncompressed adjustment module merges first and second groups of the decoded audio samples. The first and second groups are adjacent and have a length determined by a periodicity of the decoded audio samples. The uncompressed adjustment module merges the first and second groups by adding the first group multiplied by a first windowing function to the second group multiplied by a second windowing function. The second rate is approximately constant. Each of the packets includes a monotonic sequence number, and the packet loss concealment module generates one of the recovered audio frames based on a first one of the packets having the sequence number prior to a missing packet.

In still other features, the packet loss concealment module generates the one of the recovered audio frames based also on a second one of the packets having the sequence number subsequent to the missing packet. The packet loss concealment module determines the recovered audio parameters by interpolating, for each of the audio parameters, between the corresponding extracted audio parameter from the first and second ones of the packets. The packet loss concealment module determines the recovered audio parameters by extrapolating, for each of the audio parameters, from the corresponding extracted audio parameter from the first one of the packets.

In other features, the packet loss concealment module determines the recovered audio parameters by extrapolating, for each of the audio parameters, from the corresponding extracted audio parameter from the first one of the packets and from the corresponding extracted audio parameter from a second one of the packets having the sequence number prior to the first one of the packets.

A method of controlling an audio decoding system comprises receiving packets including encoded audio frames that each store audio parameters; selectively extracting the audio parameters from ones of the encoded audio frames; determining recovered audio parameters based on the extracted audio parameters; encoding the recovered audio parameters into recovered audio frames; and decoding the encoded audio frames and the recovered audio frames into decoded audio samples.

The decoded audio samples and the output stream of output samples comprise pulse-code modulation (PCM) samples. The method further comprises generating an output stream of audio samples; incorporating the decoded audio samples into the output stream at a first rate; determining a target playout time based on packet delay information of the packets; and regulating the first rate based on the target playout time. The method further comprises increasing the target playout time at a first change rate based on an increase in jitter; and decreasing the target playout time at a second change rate based on a decrease in the jitter.

In other features, the first change rate is greater than the change second rate. The packet delay information comprises a transmission delay value for each of the packets, and further comprises determining the jitter based on differences between the transmission delay values of at least two of the packets. The method further comprises, before decoding the encoded audio frames at least one of selectively inserting silent encoded audio frames and selectively deleting silent encoded audio frames; and controlling the inserting and deleting based on the target playout time.

In further features, the method further comprises inserting the silent encoded audio frames only adjacent to existing silent encoded audio frames in the audio data. The method further comprises selectively inserting the silent encoded audio frames when the target playout time is greater than a threshold; selectively deleting the silent encoded audio frames when the target playout time is less than the threshold; increasing a number of the silent encoded audio frames being inserted as the target playout time increases; and increasing a number of the silent encoded audio frames being deleted as the target playout time decreases.

In still other features, the method further comprises generating an output stream of audio samples; incorporating the decoded audio samples into the output stream at a first rate; determining a target playout time based on packet delay information of the packets; and increasing the first rate as the target playout time decreases. The output stream is read at a second rate. The method further comprises converting the output stream to analog at the second rate. The method further comprises decreasing the first rate as the target playout time increases. The method further comprises selectively inserting at least one of waveform periods and individual audio samples into the output stream when the first rate is less than the second rate.

In other features, the method further comprises incorporating all of the decoded audio samples into the output stream when the first rate is less than or equal to the second rate. The method further comprises selectively inserting the waveform periods when the output stream comprises voice data; and selectively inserting the individual audio samples when the output stream comprises other than voice data. The individual audio samples comprise at least one of silent audio samples and white noise samples. The output stream comprises voice data when a rate of zero crossings of the output stream is less than a crossing threshold.

In further features, the method further comprises inserting one of the waveform periods between first and second groups of audio samples of the output stream; and generating the one of the waveform periods based on the first and second groups. The method further comprises generating the one of the waveform periods by adding the first group multiplied by a first windowing function to the second group multiplied by a second windowing function. The method further comprises selectively inserting multiple copies of the one of the waveform periods between the first and second groups.

In still other features, the first and second groups have lengths approximately equal to a length of the one of the waveform periods. The length is determined by a periodicity of the output stream. The method further comprises determining the length of the one of the waveform periods by determining a level of periodicity of the output stream for each of a plurality of test periods; and selecting one of the plurality of test periods whose level of periodicity is highest. The method further comprises determining the level of periodicity corresponding to a first one of the plurality of test periods by performing a correlation between a first group of the audio samples of the output stream and a second group of the audio samples of the output stream.

In other features, the first and second groups are adjacent and have lengths equal to the first one of the plurality of test periods. The method further comprises omitting inserting the waveform periods when the output stream comprises unstable voice data. The output stream comprises unstable voice data when the highest level of periodicity is below a periodicity threshold. The method further comprises, when the first rate is greater than the second rate, selectively merging ones of the decoded audio samples and includes the merged audio samples in the output stream. The method further comprises merging the ones of the decoded audio samples when the output stream comprises voice data.

In further features, the method further comprises merging first and second groups of the decoded audio samples. The first and second groups are adjacent and have a length determined by a periodicity of the decoded audio samples. The method further comprises merging the first and second groups by adding the first group multiplied by a first windowing function to the second group multiplied by a second windowing function. The second rate is approximately constant. Each of the packets includes a monotonic sequence number, and further comprises generating one of the recovered audio frames based on a first one of the packets having the sequence number prior to a missing packet.

In still other features, the method further comprises generating the one of the recovered audio frames based also on a second one of the packets having the sequence number subsequent to the missing packet. The method further comprises determining the recovered audio parameters by interpolating, for each of the audio parameters, between the corresponding extracted audio parameter from the first and second ones of the packets.

In other features, the method further comprises determining the recovered audio parameters by extrapolating, for each of the audio parameters, from the corresponding extracted audio parameter from the first one of the packets. The method further comprises determining the recovered audio parameters by extrapolating, for each of the audio parameters, from the corresponding extracted audio parameter from the first one of the packets and from the corresponding extracted audio parameter from a second one of the packets having the sequence number prior to the first one of the packets.

A computer program stored on a computer-readable medium for use by a processor for operating an audio decoding system comprises receiving packets including encoded audio frames that each store audio parameters; selectively extracting the audio parameters from ones of the encoded audio frames; determining recovered audio parameters based on the extracted audio parameters; encoding the recovered audio parameters into recovered audio frames; and decoding the encoded audio frames and the recovered audio frames into decoded audio samples.

The decoded audio samples and the output stream of output samples comprise pulse-code modulation (PCM) samples. The method further comprises generating an output stream of audio samples; incorporating the decoded audio samples into the output stream at a first rate; determining a target playout time based on packet delay information of the packets; and regulating the first rate based on the target playout time. The method further comprises increasing the target playout time at a first change rate based on an increase in jitter; and decreasing the target playout time at a second change rate based on a decrease in the jitter.

In other features, the first change rate is greater than the change second rate. The packet delay information comprises a transmission delay value for each of the packets, and further comprises determining the jitter based on differences between the transmission delay values of at least two of the packets. The method further comprises, before decoding the encoded audio frames at least one of selectively inserting silent encoded audio frames and selectively deleting silent encoded audio frames; and controlling the inserting and deleting based on the target playout time.

In further features, the method further comprises inserting the silent encoded audio frames only adjacent to existing silent encoded audio frames in the audio data. The method further comprises selectively inserting the silent encoded audio frames when the target playout time is greater than a threshold; selectively deleting the silent encoded audio frames when the target playout time is less than the threshold; increasing a number of the silent encoded audio frames being inserted as the target playout time increases; and increasing a number of the silent encoded audio frames being deleted as the target playout time decreases.

In still other features, the method further comprises generating an output stream of audio samples; incorporating the decoded audio samples into the output stream at a first rate; determining a target playout time based on packet delay information of the packets; and increasing the first rate as the target playout time decreases. The output stream is read at a second rate. The method further comprises converting the output stream to analog at the second rate. The method further comprises decreasing the first rate as the target playout time increases. The method further comprises selectively inserting at least one of waveform periods and individual audio samples into the output stream when the first rate is less than the second rate.

In other features, the method further comprises incorporating all of the decoded audio samples into the output stream when the first rate is less than or equal to the second rate. The method further comprises selectively inserting the waveform periods when the output stream comprises voice data; and selectively inserting the individual audio samples when the output stream comprises other than voice data. The individual audio samples comprise at least one of silent audio samples and white noise samples. The output stream comprises voice data when a rate of zero crossings of the output stream is less than a crossing threshold.

In further features, the method further comprises inserting one of the waveform periods between first and second groups of audio samples of the output stream; and generating the one of the waveform periods based on the first and second groups. The method further comprises generating the one of the waveform periods by adding the first group multiplied by a first windowing function to the second group multiplied by a second windowing function. The method further comprises selectively inserting multiple copies of the one of the waveform periods between the first and second groups.

In still other features, the first and second groups have lengths approximately equal to a length of the one of the waveform periods. The length is determined by a periodicity of the output stream. The method further comprises determining the length of the one of the waveform periods by determining a level of periodicity of the output stream for each of a plurality of test periods; and selecting one of the plurality of test periods whose level of periodicity is highest. The method further comprises determining the level of periodicity corresponding to a first one of the plurality of test periods by performing a correlation between a first group of the audio samples of the output stream and a second group of the audio samples of the output stream.

In other features, the first and second groups are adjacent and have lengths equal to the first one of the plurality of test periods. The method further comprises omitting inserting the waveform periods when the output stream comprises unstable voice data. The output stream comprises unstable voice data when the highest level of periodicity is below a periodicity threshold. The method further comprises, when the first rate is greater than the second rate, selectively merging ones of the decoded audio samples and includes the merged audio samples in the output stream. The method further comprises merging the ones of the decoded audio samples when the output stream comprises voice data.

In further features, the method further comprises merging first and second groups of the decoded audio samples. The first and second groups are adjacent and have a length determined by a periodicity of the decoded audio samples. The method further comprises merging the first and second groups by adding the first group multiplied by a first windowing function to the second group multiplied by a second windowing function. The second rate is approximately constant. Each of the packets includes a monotonic sequence number, and further comprises generating one of the recovered audio frames based on a first one of the packets having the sequence number prior to a missing packet.

In still other features, the method further comprises generating the one of the recovered audio frames based also on a second one of the packets having the sequence number subsequent to the missing packet. The method further comprises determining the recovered audio parameters by interpolating, for each of the audio parameters, between the corresponding extracted audio parameter from the first and second ones of the packets.

In other features, the method further comprises determining the recovered audio parameters by extrapolating, for each of the audio parameters, from the corresponding extracted audio parameter from the first one of the packets. The method further comprises determining the recovered audio parameters by extrapolating, for each of the audio parameters, from the corresponding extracted audio parameter from the first one of the packets and from the corresponding extracted audio parameter from a second one of the packets having the sequence number prior to the first one of the packets.

An audio decoding system comprises buffer means for receiving packets including encoded audio frames that each store audio parameters; packet loss concealing means for selectively extracting the audio parameters from ones of the encoded audio frames, determining recovered audio parameters based on the extracted audio parameters, and encoding the recovered audio parameters into recovered audio frames; and audio decoding means for decoding the encoded audio frames and the recovered audio frames and for outputting decoded audio samples.

The decoded audio samples and the output stream of output samples comprise pulse-code modulation (PCM) samples. The audio decoding system further comprises uncompressed adjusting means for generating an output stream of audio samples and for incorporating the decoded audio samples into the output stream at a first rate; and playout control means for determining a target playout time based on packet delay information of the packets and for regulating the first rate based on the target playout time. The playout control means increases the target playout time at a first change rate based on an increase in jitter, and decreases the target playout time at a second change rate based on a decrease in the jitter.

In other features, the first change rate is greater than the change second rate. The packet delay information comprises a transmission delay value for each of the packets, and the playout control means determines the jitter based on differences between the transmission delay values of at least two of the packets. The audio decoding system further comprises silence interval adjusting means for, before the audio decoding means decodes the encoded audio frames, at least one of selectively inserting silent encoded audio frames and selectively deleting silent encoded audio frames. The playout control means controls the silence interval adjusting means based on the target playout time.

In further features, the silence interval adjusting means only inserts the silent encoded audio frames adjacent to existing silent encoded audio frames in the audio data. The playout control means causes the silence interval adjusting means to selectively insert the silent encoded audio frames when the target playout time is greater than a threshold, and to selectively delete the silent encoded audio frames when the target playout time is less than the threshold. A number of the silent encoded audio frames being inserted increases as the target playout time increases. A number of the silent encoded audio frames being deleted increases as the target playout time decreases.

In still other features, the audio decoding system further comprises uncompressed adjusting means for generating an output stream of audio samples and for incorporating the decoded audio samples into the output stream at a first rate; and playout control means for determining a target playout time based on packet delay information of the packets and for increasing the first rate as the target playout time decreases. The output stream is read from the uncompressed adjusting means at a second rate. An audio playback system comprises the audio decoding system and digital to analog conversion means for converting the output stream to analog at the second rate.

In other features, the playout control means decreases the first rate as the target playout time increases. The uncompressed adjusting means selectively inserts at least one of waveform periods and individual audio samples into the output stream when the first rate is less than the second rate. The uncompressed adjusting means incorporates all of the decoded audio samples into the output stream when the first rate is less than or equal to the second rate. The uncompressed adjusting means selectively inserts the waveform periods when the output stream comprises voice data, and selectively inserts the individual audio samples otherwise.

In further features, the individual audio samples comprise at least one of silent audio samples and white noise samples. The output stream comprises voice data when a rate of zero crossings of the output stream is less than a crossing threshold. The uncompressed adjusting means inserts one of the waveform periods between first and second groups of audio samples of the output stream, and generates the one of the waveform periods based on the first and second groups. The uncompressed adjusting means generates the one of the waveform periods by adding the first group multiplied by a first windowing function to the second group multiplied by a second windowing function.

In still other features, the uncompressed adjusting means selectively inserts multiple copies of the one of the waveform periods between the first and second groups. The first and second groups have lengths approximately equal to a length of the one of the waveform periods. The length is determined by a periodicity of the output stream. The uncompressed adjusting means determines the length of the one of the waveform periods by determining a level of periodicity of the output stream for each of a plurality of test periods and selecting one of the plurality of test periods whose level of periodicity is highest. The uncompressed adjusting means determines the level of periodicity corresponding to a first one of the plurality of test periods by performing a correlation between a first group of the audio samples of the output stream and a second group of the audio samples of the output stream.

In other features, the first and second groups are adjacent and have lengths equal to the first one of the plurality of test periods. The uncompressed adjusting means omits inserting the waveform periods when the output stream comprises unstable voice data. The output stream comprises unstable voice data when the highest level of periodicity is below a periodicity threshold. When the first rate is greater than the second rate, the uncompressed adjusting means selectively merges ones of the decoded audio samples and includes the merged audio samples in the output stream. The uncompressed adjusting means merges the ones of the decoded audio samples when the output stream comprises voice data.

In further features, the uncompressed adjusting means merges first and second groups of the decoded audio samples. The first and second groups are adjacent and have a length determined by a periodicity of the decoded audio samples. The uncompressed adjusting means merges the first and second groups by adding the first group multiplied by a first windowing function to the second group multiplied by a second windowing function. The second rate is approximately constant. Each of the packets includes a monotonic sequence number, and the packet loss concealing means generates one of the recovered audio frames based on a first one of the packets having the sequence number prior to a missing packet.

In still other features, the packet loss concealing means generates the one of the recovered audio frames based also on a second one of the packets having the sequence number subsequent to the missing packet. The packet loss concealing means determines the recovered audio parameters by interpolating, for each of the audio parameters, between the corresponding extracted audio parameter from the first and second ones of the packets. The packet loss concealing means determines the recovered audio parameters by extrapolating, for each of the audio parameters, from the corresponding extracted audio parameter from the first one of the packets.

In other features, the packet loss concealing means determines the recovered audio parameters by extrapolating, for each of the audio parameters, from the corresponding extracted audio parameter from the first one of the packets and from the corresponding extracted audio parameter from a second one of the packets having the sequence number prior to the first one of the packets.

A packet loss concealment system comprises a first buffer that stores audio samples prior to a missing section of audio samples; a second buffer that stores audio samples subsequent to the missing section; a forward propagation module that generates a forward propagated waveform by propagating a first waveform period that is based on the first buffer; a backward propagation module that generates a backward propagated waveform by propagating a second waveform period that is based on the second buffer; and a ratio control module that selectively determines a ratio between a first periodicity of the audio samples in the second buffer and a second periodicity of the audio samples in the first buffer. The forward propagation module selectively propagates the first waveform period using the ratio, and the backward propagation module propagates the second waveform period using an inverse of the ratio.

The forward propagation module increases periodicity of the first waveform period linearly when propagating the first waveform period. The forward propagation module increases periodicity of the first waveform period approximately exponentially when propagating the first waveform period. The forward propagation module increases periodicity of the first waveform period according to a second-order function of sample number. The second-order function has a second-order coefficient that is based on a difference between the first and second periodicities. The second-order coefficient is based on a first quantity divided by twice a second quantity.

In other features, the first quantity comprises the difference, and the second quantity comprises a sum of a square of the second periodicity and twice a product of the second periodicity and a gap length. The gap length is a length in samples of the missing section. The second-order function has a first-order coefficient of one and a zero-order coefficient of zero. The packet loss concealment system further comprises a comparison module that compares the second waveform period to the forward propagated waveform and outputs a similarity signal. The similarity signal comprises a correlation coefficient between the second waveform period and the forward propagated waveform.

In further features, the ratio control module serially provides a plurality of ratios to the forward propagation module and chooses one of the plurality of ratios that results in a greatest similarity signal from the comparison module. The ratio control module selectively provides the one of the plurality of ratios to the forward and backward propagation modules. The ratio control module provides a ratio of 1 to the forward and backward propagation modules when the greatest similarity signal is less than a threshold. The packet loss concealment system further comprises a first repeatable period module that determines the first periodicity and that generates the first waveform period based on a first group of audio samples in the first buffer having a length equal to the first periodicity.

In still other features, the first repeatable period module determines the first periodicity by determining a level of periodicity of the first buffer for each of a plurality of test periods and selecting one of the plurality of test periods whose level of periodicity is highest. The first repeatable period module determines the level of periodicity corresponding to a first one of the plurality of test periods by performing a correlation between a first section of the first buffer and a second section of the first buffer. The first and second sections are adjacent and have lengths equal to the first one of the plurality of test periods.

In other features, the first repeatable period module combines a second group of the audio samples in the first buffer with ones of the first group of audio samples. The first and second groups are adjacent. The ones of the first group of audio samples are located in the first group on an end opposite to the second group. A length of the second group is a predetermined length. A length of the second group is proportional to the first periodicity. The first repeatable period module adds a product of the first group and a first windowing function to a product of the second group and a second windowing function.

In further features, the packet loss concealment system further comprises a blending module that selectively fills the missing section by combining a forward waveform based on the forward propagated waveform and a backward waveform based on the backward propagated waveform. The blending module adds a product of the forward waveform and a first windowing function to a product of the backward waveform and a second windowing function. The forward waveform comprises at least part of the forward propagated waveform when the first buffer comprises voice data. The first buffer comprises voice data when a rate of zero crossings of the audio samples in the first buffer is less than a crossing threshold. The forward waveform comprises filler samples when the first buffer comprises other than voice data.

In still other features, the filler samples comprise at least one of silent samples and white noise samples. The backward waveform comprises at least part of the backward propagated waveform when the second buffer comprises voice data. The second buffer comprises voice data when a rate of zero crossings of the audio samples in the second buffer is less than a crossing threshold. The backward waveform comprises filler samples when the second buffer comprises other than voice data. The filler samples comprise one of silent samples and white noise samples.

A method of controlling a packet loss concealment system comprises storing audio samples prior to a missing section of audio samples; storing audio samples subsequent to the missing section; generating a forward propagated waveform by propagating a first waveform period that is based on the prior audio samples; generating a backward propagated waveform by propagating a second waveform period that is based on the subsequent audio samples; selectively determining a ratio between a first periodicity of the subsequent audio samples and a second periodicity of the prior audio samples; selectively propagating the first waveform period using the ratio; and propagating the second waveform period using an inverse of the ratio.

The method further comprises increasing periodicity of the first waveform period linearly when propagating the first waveform period. The method further comprises increasing periodicity of the first waveform period approximately exponentially when propagating the first waveform period. The method further comprises increasing periodicity of the first waveform period according to a second-order function of sample number. The second-order function has a second-order coefficient that is based on a difference between the first and second periodicities. The second-order coefficient is based on a first quantity divided by twice a second quantity.

In other features, the first quantity comprises the difference, and the second quantity comprises a sum of a square of the second periodicity and twice a product of the second periodicity and a gap length. The gap length is a length in samples of the missing section. The second-order function has a first-order coefficient of one and a zero-order coefficient of zero. The method further comprises comparing the second waveform period to the forward propagated waveform and outputs a similarity signal. The similarity signal comprises a correlation coefficient between the second waveform period and the forward propagated waveform.

In further features, the method further comprises repeatedly performing the forward propagating using a plurality of ratios; and choosing one of the plurality of ratios that results in a greatest similarity signal. The method further comprises performing the forward and backward propagating using the one of the plurality of ratios. The method further comprises performing the forward and backward propagating using a ratio of 1 when the greatest similarity signal is less than a threshold. The method further comprises determining the first periodicity; and generating the first waveform period based on a first group of the prior audio samples having a length equal to the first periodicity.

In still other features, the method further comprises determining the first periodicity by determining a level of periodicity of the prior audio samples for each of a plurality of test periods; and selecting one of the plurality of test periods whose level of periodicity is highest. The method further comprises determining the level of periodicity corresponding to a first one of the plurality of test periods by performing a correlation between a first section of the prior audio samples and a second section of the prior audio samples. The first and second sections are adjacent and have lengths equal to the first one of the plurality of test periods. The method further comprises combining a second group of the prior audio samples with ones of the first group of audio samples.

In other features, the first and second groups are adjacent. The ones of the first group of audio samples are located in the first group on an end opposite to the second group. A length of the second group is a predetermined length. A length of the second group is proportional to the first periodicity. The method further comprises adding a product of the first group and a first windowing function to a product of the second group and a second windowing function. The method further comprises selectively filling the missing section by combining a forward waveform based on the forward propagated waveform and a backward waveform based on the backward propagated waveform.

In further features, the method further comprises adding a product of the forward waveform and a first windowing function to a product of the backward waveform and a second windowing function. The forward waveform comprises at least part of the forward propagated waveform when the prior audio samples comprise voice data. The prior audio samples comprise voice data when a rate of zero crossings of the prior audio samples is less than a crossing threshold. The forward waveform comprises filler samples when the prior audio samples comprise other than voice data.

In still other features, the filler samples comprise at least one of silent samples and white noise samples. The backward waveform comprises at least part of the backward propagated waveform when the subsequent audio samples comprise voice data. The subsequent audio samples comprise voice data when a rate of zero crossings of the subsequent audio samples is less than a crossing threshold. The backward waveform comprises filler samples when the subsequent audio samples comprise other than voice data. The filler samples comprise one of silent samples and white noise samples.

A computer program stored on a computer-readable medium for use by a processor for operating a packet loss concealment system comprises storing audio samples prior to a missing section of audio samples; storing audio samples subsequent to the missing section; generating a forward propagated waveform by propagating a first waveform period that is based on the prior audio samples; generating a backward propagated waveform by propagating a second waveform period that is based on the subsequent audio samples; selectively determining a ratio between a first periodicity of the subsequent audio samples and a second periodicity of the prior audio samples; selectively propagating the first waveform period using the ratio; and propagating the second waveform period using an inverse of the ratio.

The method further comprises increasing periodicity of the first waveform period linearly when propagating the first waveform period. The method further comprises increasing periodicity of the first waveform period approximately exponentially when propagating the first waveform period. The method further comprises increasing periodicity of the first waveform period according to a second-order function of sample number. The second-order function has a second-order coefficient that is based on a difference between the first and second periodicities. The second-order coefficient is based on a first quantity divided by twice a second quantity.

In other features, the first quantity comprises the difference, and the second quantity comprises a sum of a square of the second periodicity and twice a product of the second periodicity and a gap length. The gap length is a length in samples of the missing section. The second-order function has a first-order coefficient of one and a zero-order coefficient of zero. The method further comprises comparing the second waveform period to the forward propagated waveform and outputs a similarity signal. The similarity signal comprises a correlation coefficient between the second waveform period and the forward propagated waveform.

In further features, the method further comprises repeatedly performing the forward propagating using a plurality of ratios; and choosing one of the plurality of ratios that results in a greatest similarity signal. The method further comprises performing the forward and backward propagating using the one of the plurality of ratios. The method further comprises performing the forward and backward propagating using a ratio of 1 when the greatest similarity signal is less than a threshold. The method further comprises determining the first periodicity; and generating the first waveform period based on a first group of the prior audio samples having a length equal to the first periodicity.

In still other features, the method further comprises determining the first periodicity by determining a level of periodicity of the prior audio samples for each of a plurality of test periods; and selecting one of the plurality of test periods whose level of periodicity is highest. The method further comprises determining the level of periodicity corresponding to a first one of the plurality of test periods by performing a correlation between a first section of the prior audio samples and a second section of the prior audio samples. The first and second sections are adjacent and have lengths equal to the first one of the plurality of test periods. The method further comprises combining a second group of the prior audio samples with ones of the first group of audio samples.

In other features, the first and second groups are adjacent. The ones of the first group of audio samples are located in the first group on an end opposite to the second group. A length of the second group is a predetermined length. A length of the second group is proportional to the first periodicity. The method further comprises adding a product of the first group and a first windowing function to a product of the second group and a second windowing function. The method further comprises selectively filling the missing section by combining a forward waveform based on the forward propagated waveform and a backward waveform based on the backward propagated waveform.

In further features, the method further comprises adding a product of the forward waveform and a first windowing function to a product of the backward waveform and a second windowing function. The forward waveform comprises at least part of the forward propagated waveform when the prior audio samples comprise voice data. The prior audio samples comprise voice data when a rate of zero crossings of the prior audio samples is less than a crossing threshold. The forward waveform comprises filler samples when the prior audio samples comprise other than voice data.

In still other features, the filler samples comprise at least one of silent samples and white noise samples. The backward waveform comprises at least part of the backward propagated waveform when the subsequent audio samples comprise voice data. The subsequent audio samples comprise voice data when a rate of zero crossings of the subsequent audio samples is less than a crossing threshold. The backward waveform comprises filler samples when the subsequent audio samples comprise other than voice data. The filler samples comprise one of silent samples and white noise samples.

A packet loss concealment system comprises first storage means for storing audio samples prior to a missing section of audio samples; second storage means for storing audio samples subsequent to the missing section; forward propagation means for generating a forward propagated waveform by propagating a first waveform period that is based on the first storage means; backward propagation means for generating a backward propagated waveform by propagating a second waveform period that is based on the second storage means; and ratio control means for selectively determining a ratio between a first periodicity of the audio samples in the second storage means and a second periodicity of the audio samples in the first storage means. The forward propagation means selectively propagates the first waveform period using the ratio, and the backward propagation means propagates the second waveform period using an inverse of the ratio.

The forward propagation means increases periodicity of the first waveform period linearly when propagating the first waveform period. The forward propagation means increases periodicity of the first waveform period approximately exponentially when propagating the first waveform period. The forward propagation means increases periodicity of the first waveform period according to a second-order function of sample number. The second-order function has a second-order coefficient that is based on a difference between the first and second periodicities.

In other features, the second-order coefficient is based on a first quantity divided by twice a second quantity. The first quantity comprises the difference, and the second quantity comprises a sum of a square of the second periodicity and twice a product of the second periodicity and a gap length. The gap length is a length in samples of the missing section. The second-order function has a first-order coefficient of one and a zero-order coefficient of zero. The packet loss concealment system further comprises comparison means for comparing the second waveform period to the forward propagated waveform and outputs a similarity signal.

In further features, the similarity signal comprises a correlation coefficient between the second waveform period and the forward propagated waveform. The ratio control means serially provides a plurality of ratios to the forward propagation means and chooses one of the plurality of ratios that results in a greatest similarity signal from the comparison means. The ratio control means selectively provides the one of the plurality of ratios to the forward and backward propagation means. The ratio control means provides a ratio of 1 to the forward and backward propagation means when the greatest similarity signal is less than a threshold.

In still other features, the packet loss concealment system further comprises first repeatable period means for determining the first periodicity and for generating the first waveform period based on a first group of audio samples in the first storage means having a length equal to the first periodicity. The first repeatable period means determines the first periodicity by determining a level of periodicity of the first storage means for each of a plurality of test periods and selecting one of the plurality of test periods whose level of periodicity is highest.

In other features, the first repeatable period means determines the level of periodicity corresponding to a first one of the plurality of test periods by performing a correlation between a first section of the first storage means and a second section of the first storage means. The first and second sections are adjacent and have lengths equal to the first one of the plurality of test periods. The first repeatable period means combines a second group of the audio samples in the first storage means with ones of the first group of audio samples. The first and second groups are adjacent.

In further features, the ones of the first group of audio samples are located in the first group on an end opposite to the second group. A length of the second group is a predetermined length. A length of the second group is proportional to the first periodicity. The first repeatable period means adds a product of the first group and a first windowing function to a product of the second group and a second windowing function. The packet loss concealment system further comprises blending means for selectively filling the missing section by combining a forward waveform based on the forward propagated waveform and a backward waveform based on the backward propagated waveform.

In still other features, the blending means adds a product of the forward waveform and a first windowing function to a product of the backward waveform and a second windowing function. The forward waveform comprises at least part of the forward propagated waveform when the first storage means comprises voice data. The first storage means comprises voice data when a rate of zero crossings of the audio samples in the first storage means is less than a crossing threshold. The forward waveform comprises filler samples when the first storage means comprises other than voice data. The filler samples comprise at least one of silent samples and white noise samples.

In other features, the backward waveform comprises at least part of the backward propagated waveform when the second storage means comprises voice data. The second storage means comprises voice data when a rate of zero crossings of the audio samples in the second storage means is less than a crossing threshold. The backward waveform comprises filler samples when the second storage means comprises other than voice data. The filler samples comprise one of silent samples and white noise samples.

In still other features, the systems and methods described above are implemented by a computer program executed by one or more processors. The computer program can reside on a computer readable medium such as but not limited to memory, non-volatile data storage, and/or other suitable tangible storage mediums.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
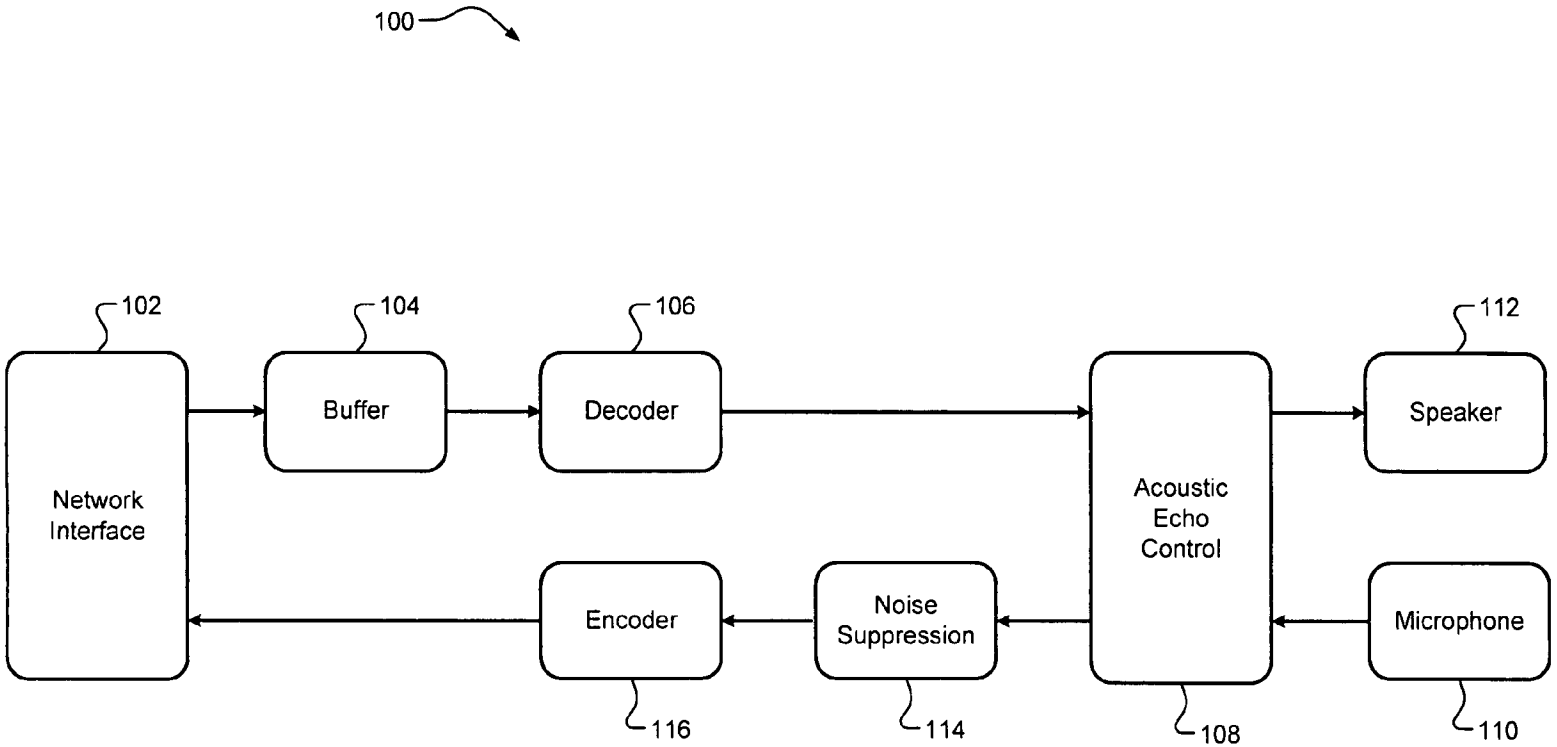
FIG. 1 Prior Art
FIG. 1 is a functional block diagram of a Voice over IP (VoIP) phone according to the prior art.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module refers to an Application Specific Integrated Circuit (ASIC), an electronic circuit, a processor (shared, dedicated, or group) and memory that execute one or more software or firmware programs, a combinational logic circuit, and/or other suitable hardware components that provide the described functionality.

Figure 2:
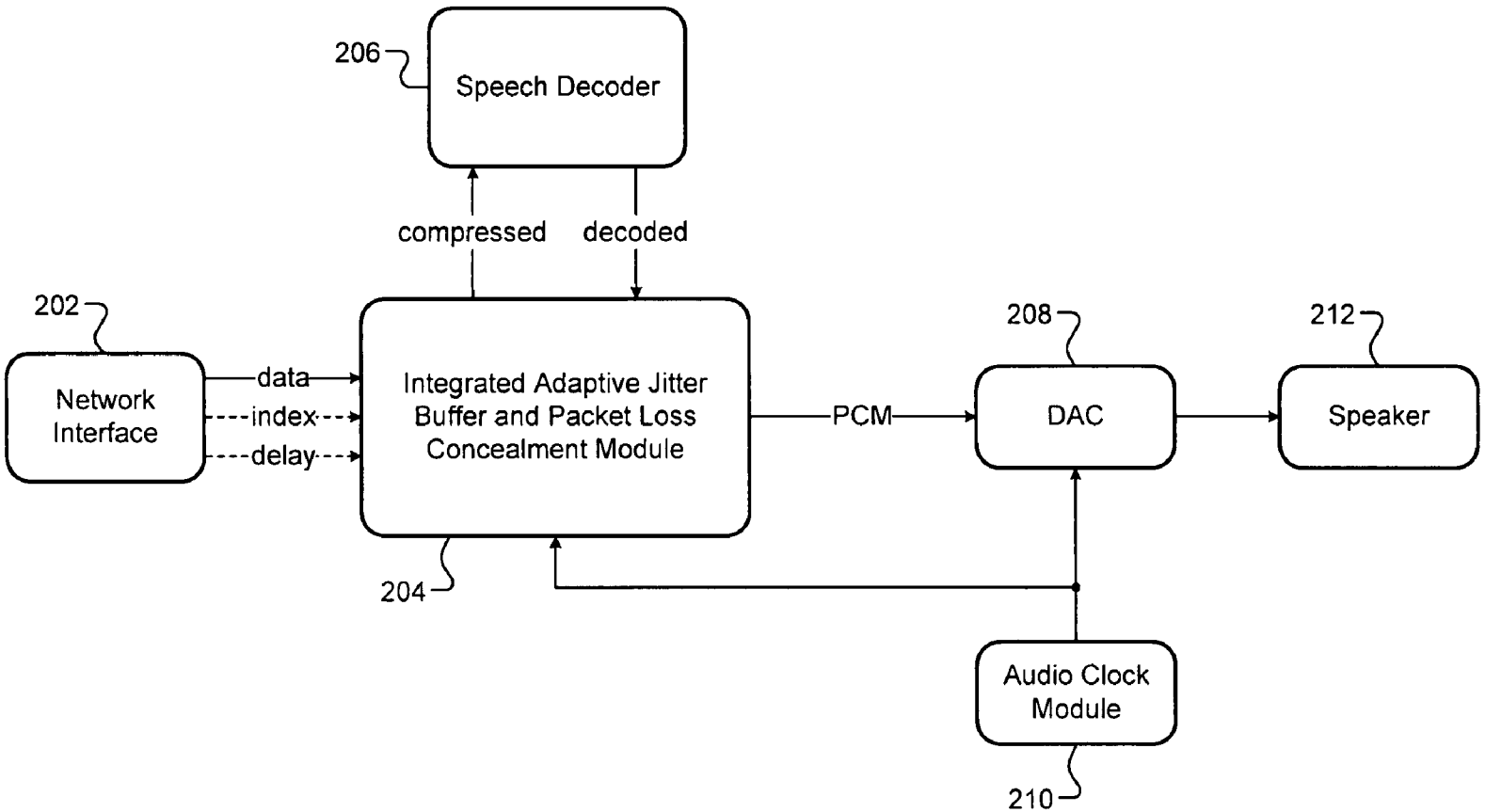
FIG. 2 is a functional block diagram of an exemplary simplified receive portion of a VoIP phone.

Referring now to FIG. 2, a functional block diagram of an exemplary simplified receive portion of a VoIP phone is presented. A network interface 202 connects to a network, such as the internet, using a wired and/or a wireless protocol. The network interface 202 receives packets over the network. The packets include encoded audio data and a sequential number indicating the original order of the encoded audio data.

The network interface 202 passes the encoded audio data to an integrated adaptive jitter buffer and packet loss concealment (AJB/PLC) module 204, where it is buffered. In addition to the encoded audio data, the network interface 202 may provide the sequential number (or index) of the encoded audio data. The network interface 202 may also provide a delay value, which may be an absolute delay from the time the encoded audio data was sent by a remote terminal to the time the packet was received by the network interface 202. Variations in the delay value are referred to as jitter.

The index may be used to rearrange received encoded audio data into the original order. The index may also be used to identify lost packets. The integrated AJB/PLC module 204 passes encoded audio data to a speech decoder 206, and receives decoded audio data. The decoded audio data may be received as monaural post-code modulation (PCM) data. The speech decoder 206 may include built-in packet loss concealment. The integrated AJB/PLC module also includes packet loss concealment capability.

The integrated AJB/PLC module outputs decoded audio data, such as PCM data, to a digital to analog converter (DAC) 208. Based on an audio clock from an audio clock module 210, the DAC 208 converts the PCM data into analog values. The analog values are output to a speaker 212, and may be amplified. The audio clock module 210 may also provide the audio clock to the integrated AJB/PLC module 204. For example only, the audio clock may have a frequency of approximately 8 kHz.

The PCM data output to the DAC 208 may be output at a constant rate determined by the audio clock module 210. A playout module of the integrated AJB/PLC module 204 may output decoded data to the DAC 208. When the buffer delay is constant, the playout module may output decoded data unchanged to the DAC 208.

The integrated AJB/PLC module 204 may change the delay of the buffer based upon measured jitter. To increase the buffer delay, the playout module decreases the rate at which decoded data is incorporated into the output PCM stream to the DAC 208. This slower rate allows the delay in the buffer to increase. The DAC 208 still expects a PCM output stream at the constant rate specified by the audio clock module 210. The playout module therefore inserts additional data into the PCM output stream.

The playout module may replicate decoded data to create this additional data. The additional data may also be created by inserting filler samples, such as white noise and/or silence. To decrease the buffer delay, the playout module increases the rate at which decoded data is incorporated into the PCM stream. Because the PCM stream is fixed rate, sections of the decoded data may be deleted and/or combined to allow for more decoded data to be incorporated into the PCM stream.

Figure 3:
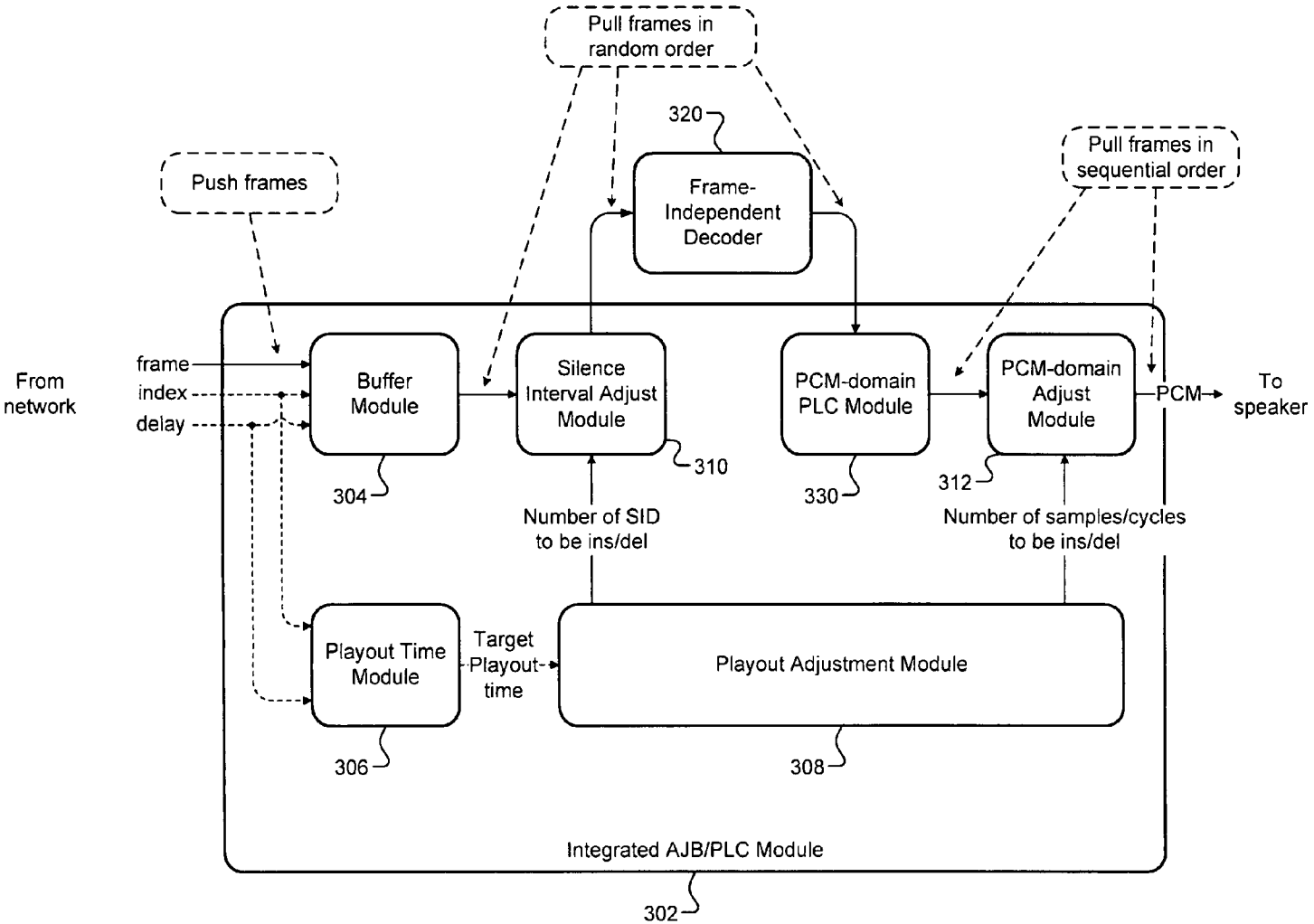
FIG. 3 is a functional block diagram of an exemplary integrated AJB/PLC module for use with a frame-independent codec.

Referring now to FIG. 3, a functional block diagram of an exemplary integrated AJB/PLC module 302 for use with a frame-independent codec is shown. A frame-independent codec can decode a single frame without reference to previous or subsequent frames. By contrast, a frame-dependent codec decodes a frame based upon previously received frames. Because a frame-independent codec can decode frames individually, the frames can be decoded out of order and reordered downstream.

The integrated AJB/PLC module 302 includes a buffer module 304. The buffer module 304 receives frame data, a frame index, and a frame delay. The frame index and frame delay are also received by a playout time module 306. The playout time module 306 determines a target playout time, which controls how fast decoded audio data is converted into an output stream, such as a PCM output stream.

The target playout time may be specified as a ratio. For example, at a ratio of 1.0, 100 ms of decoded audio data will be output as 100 ms of PCM output data. Continuing this example, a ratio of 0.5 may indicate that 100 ms of decoded audio data will be shortened into 50 ms of PCM data. A ratio of 2.0 may expand 100 ms of decoded audio data into 200 ms of PCM data.

Figure 5:
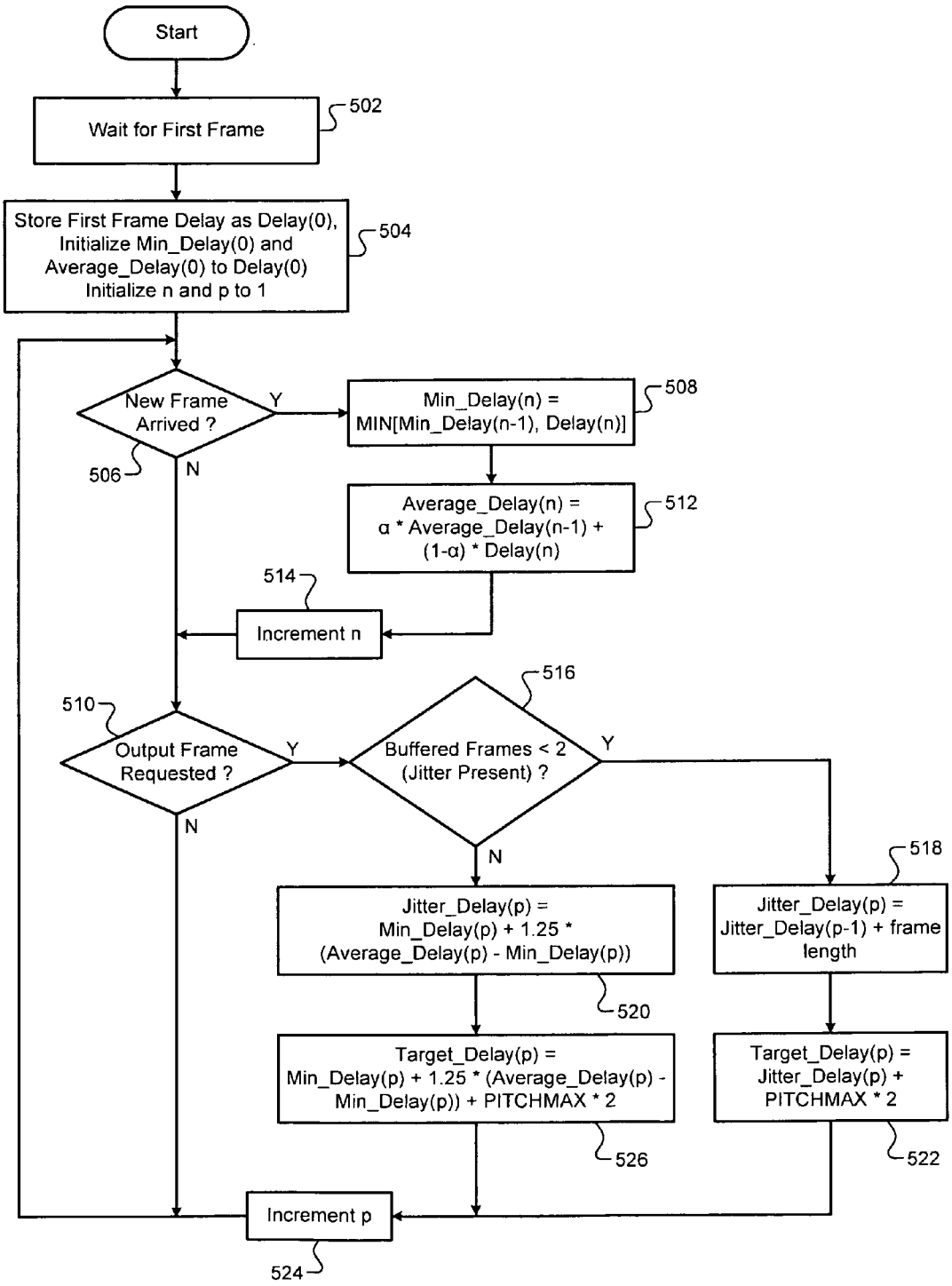
FIG. 5 is a flowchart depicting exemplary steps performed in operating the playout time module.

The playout time module 306 increases the target playout time to create a greater delay in the buffer module 304. The playout time module 306 reduces the target playout time in order to reduce the delay in the buffer module 304. The playout time module 306 may implement a method such as is shown in FIG. 5. Additionally, the playout time module 306 may include a Spike-delay Adjustment and MOS-based playout buffer Algorithm (SAMOSA), as described in The Impact Of Adaptive Playout Buffer Algorithm On Perceived Speech Quality Transported Over IP Networks, September 2003, Pin Hu, Master's Thesis at the University of Plymouth, the disclosure of which is hereby incorporated by reference in its entirety.

A playout adjustment module 308 attempts to achieve the target playout time specified by the playout time module 306. The playout adjustment module 308 may coordinate operation of a silence interval adjust module 310 and a PCM-domain adjust module 312. The silence interval adjust module 310 may operate at the frame level, inserting or deleting silent audio frames. Silent audio frames may be specially designated in some codecs or may be simply standard audio frames containing silence. The silence interval adjust module 310 inserts or deletes these silent frames based on the control of the playout adjustment module 308.

The playout adjustment module 308 also controls the PCM audio stream via the PCM-domain adjust module 312. The PCM-domain adjust module 312 is described in more detail with respect to FIGS. 6 and 7A-7C. The PCM-domain adjust module 312 may insert or delete individual PCM samples. In addition, the PCM-domain adjust module 312 may insert or delete entire periods of periodic audio data.

The playout adjustment module 308 may react to increases in target playout time immediately. For example, the playout adjustment module may immediately instruct silent frames to be inserted by the silence interval adjust module 310 and instruct PCM samples and/or periodic data to be inserted by the PCM-domain adjust module 312.

Decreases in the target playout time may be responded to more slowly. For example, the playout adjustment module 308 may reduce playout time at a fixed rate until the target playout time is reached. The playout adjustment module 308 may limit decreases in playout time to periods of silence or of stable voice audio. Stable and unstable voice data will be described in more detail below, although stable voice data may simply be characterized as more periodic.

The playout adjustment module 308 may apportion speeding up and slowing down between the silence interval adjust module 310 and the PCM-domain adjust module 312 based on the type of audio data being processed. For example, the silence interval adjust module 310 may only change lengths of silence with a granularity of one or more frames. For stable voice data, the PCM-domain adjust module 312 can adjust the PCM audio stream with the granularity of a periodic voice data. For other audio data, the PCM-domain adjust module 312 may be able to insert or delete individual PCM audio samples.

The buffer module 304 receives frame data whenever a packet arrives. In other words, the buffer module 304 does not pull frame data, but frame data is instead pushed to the buffer module 304 upon arrival. The silence interval adjust module 310 pulls frames from the buffer module 304. The silence interval adjust module 310 may delete silent frames from the frames pulled from the buffer module 304. Alternatively, the silence interval adjust module 310 may insert additional silent frames into the set of frames for transmission to a frame-independent decoder 320.

The frame-independent decoder 320 may be external to the integrated AJB/PLC module 302. When external, this may allow the integrated AJB/PLC module 302 to be used with various external codecs. The silence interval adjust module 310 may need to be modified and/or configured based on the codec selected for the frame-independent decoder 320. For example, different codecs may define silent frames differently.

The frame-independent decoder 320 pulls frames from the silence interval adjust module 310. Because the frame-independent decoder 320 can decode each frame independently of prior frames, frames may be pulled and decoded in any order. Decoded audio data is then pulled from the frame-independent decoder 320 by a PCM-domain packet loss concealment (PLC) module 330. The frame-independent decoder 320 may implement packet loss concealment.

The PCM-domain PLC module 330 may provide packet loss concealment complementary to the frame independent decoder 320. Alternatively, the PCM-domain PLC module 330 may be disabled when the frame-independent decoder 320 performs packet loss concealment. The PCM-domain PLC module 330 may extrapolate and/or interpolate missing audio frames. Operation of the PCM-domain PLC module 330 is described in more detail with respect to FIGS. 8-16. In various implementations, the PCM-domain PLC module 330 may be omitted.

The PCM-domain adjust module 312 pulls frames from the PCM-domain PLC module 330 sequentially. The PCM-domain adjust module 312 inserts or deletes audio samples and/or periods of periodic data based on control signals from the playout adjustment module 308. The resulting PCM stream is pulled at a fixed rate for playback. The samples may be pulled at the rate at which a microphone at the remote terminal sampled the original audio data. For example, this rate may be 8 kHz.

Figure 4:
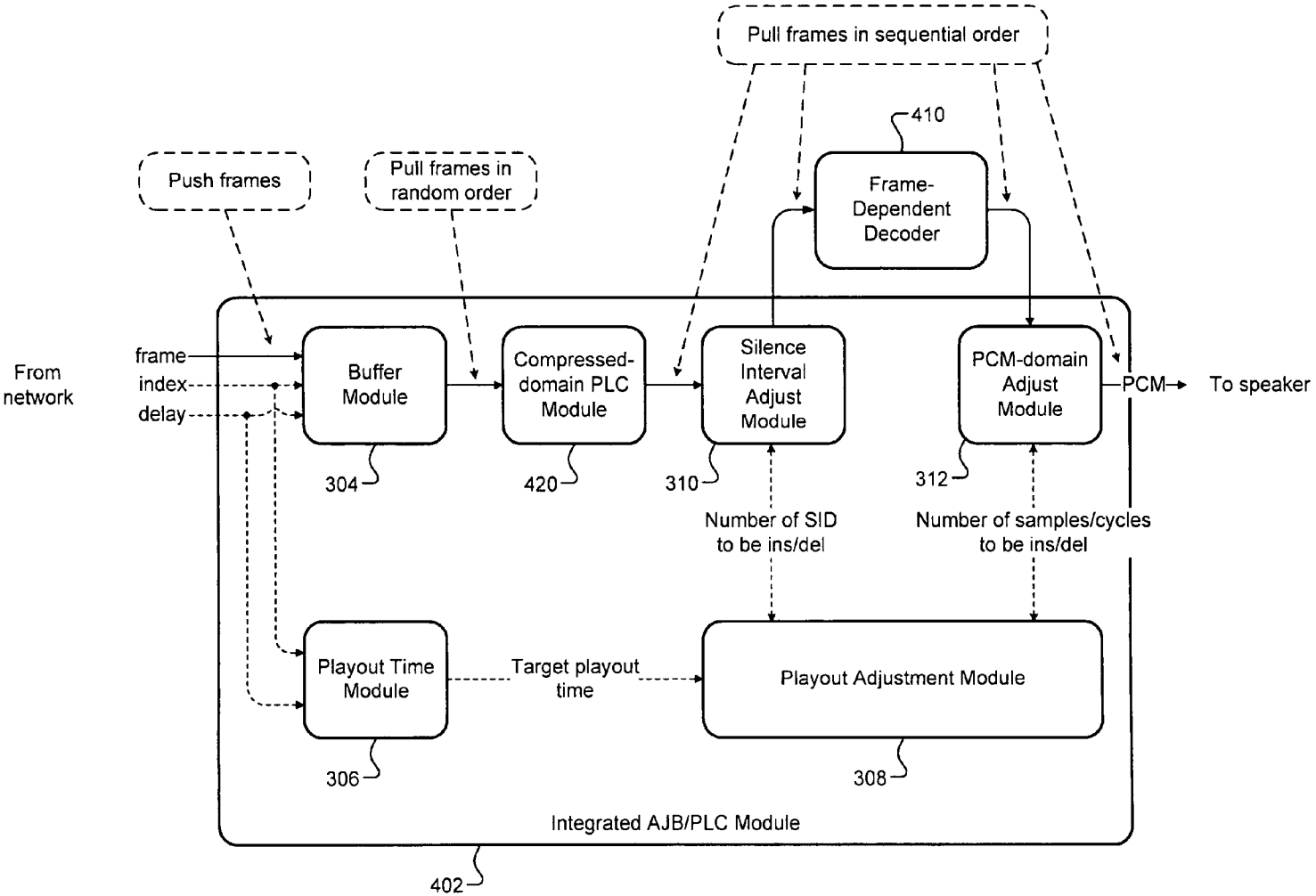
FIG. 4 is a functional block diagram of an exemplary integrated AJB/PLC module for use with a frame-dependent codec.

Referring now to FIG. 4, a functional block diagram of an exemplary integrated AJB/PLC module 402 for use with a frame-dependent codec is shown. The buffer module 304, the playout time module 306, the playout adjustment module 308, and the PCM-domain adjust module 312 may be similar to those implemented in the integrated AJB/PLC module 302 of FIG. 3. In FIG. 4, a frame-dependent decoder 410 is used.

The frame-dependent decoder 410 decodes each frame based on previously decoded frames. Therefore, lost frames are reconstructed prior to decoding by the frame-dependent decoder 410. Therefore, a compressed-domain PLC module 420 pulls data from the buffer module 304. The compressed-domain PLC module 420 attempts to conceal packet loss in the compressed-domain, and is described in more detail with respect to FIG. 17.

When the frame-dependent codec encodes speech parameters into each frame, the compressed-domain PLC module 420 may extract those speech parameters from frames surrounding a missing frame. For example, the compressed-domain PLC module 420 may extract the speech parameters from a frame prior to the missing frame and from a frame subsequent to the missing frame and interpolate each of the speech parameters to estimate the speech parameters of the missing frame.

Those interpolated speech parameters can then be compressed back into a compressed frame. When the frame-dependent decoder 410 receives this group of frames, the reconstructed frame and the frame following the reconstructed frames may be more accurately decoded than if that frame were missing completely. The compressed-domain PLC module 420 may also extrapolate speech parameters from one or more frames prior to or subsequent to the missing frame. For example, the compressed-domain PLC module 420 may extrapolate speech parameters from the two frames prior to the missing frame so that the compressed-domain PLC module 420 does not have to wait to receive the frame following the missing frame.

The silence interval adjust module 310 pulls frames from the compressed-domain PLC module 420 in sequential order, and inserts or deletes silent frames. The silence interval adjust module 310 may be similar to that of FIG. 3, and may be modified based upon the codec implemented in the frame-dependent decoder 410. The frame-dependent decoder 410 pulls frames from the silence interval adjust module 310 in sequential order.

The PCM-domain adjust module 312 then pulls decoded audio frames from the frame-dependent decoder 410. If the frame-dependent decoder 410 implements packet loss concealment, packet loss concealment may be disabled or modified in the compressed-domain PLC module 420. The PCM-domain adjust module 312 incorporates decoded data from the frame-dependent decoder 410 into an output PCM stream at a rate determined by the playout adjustment module 308.

Referring now to FIG. 5, a flowchart depicts exemplary steps performed in operating the playout time module 306. Control begins in step 502, where control waits for the first frame to arrive. Control continues in step 504, where control stores the first frame's delay in transit over the network as Delay(0). Control initializes the minimum delay, Min_Delay (0), and the average delay, Average_Delay(0), to the value of Delay(0). Indices n and p are also initialized to 1.

Control continues in step 506, where control determines whether a new frame has arrived. If so, control transfers to step 508; otherwise, control transfers to step 510. In step 508, control sets Min_Delay(n) to the minimum of Min_Delay(n−1) and Delay(n). Control continues in step 512, where Average_Delay(n) is set equal to $\alpha$*Average_Delay(n−1)+(1−$\alpha$)*Delay(n), where $\alpha$ is the ratio of (n−1) to n. Control then continues in step 514, where n is incremented, and control continues in step 510.

In step 510, control determines whether a request has been made to output a frame. If so, control transfers to step 516. Otherwise, control returns to step 506. In step 516, control determines whether jitter is present. For example, control may compare the number of buffered frames to 2. If the number of buffered frames is less than 2, control may consider jitter to be present. If jitter is present, control transfers to step 518; otherwise, control transfers to step 520.

In step 518, control sets Jitter_Delay(p) to be equal to Jitter_Delay(p−1) plus the length of time encoded in a frame. Control continues in step 522, where control sets Target_Delay(p) to be equal to Jitter_Delay(p)+PITCHMAX*2. PITCHMAX may be a constant that specifies the longest supported pitch. Pitch in the context of this application may refer to the length of the period of a periodic waveform. For example, the pitch may be measured as the number of PCM samples within the period of a periodic waveform. For example only, PITCHMAX may be equal to 120 when the PCM rate is 8 kHz.

Control continues in step 524, where p is incremented, and control returns to step 506. In step 520, Jitter_Delay(p) is set equal to Min_Delay(p)+1.25*[Average_Delay(p)−Min_Delay(p)]. Control then continues in step 526, where Target_Delay(p) is set equal to Min_Delay(p)+1.25*[Average_Delay(p)−Min_Delay (p)]+PITCHMAX*2. Control then continues in step 524.

Figure 6:
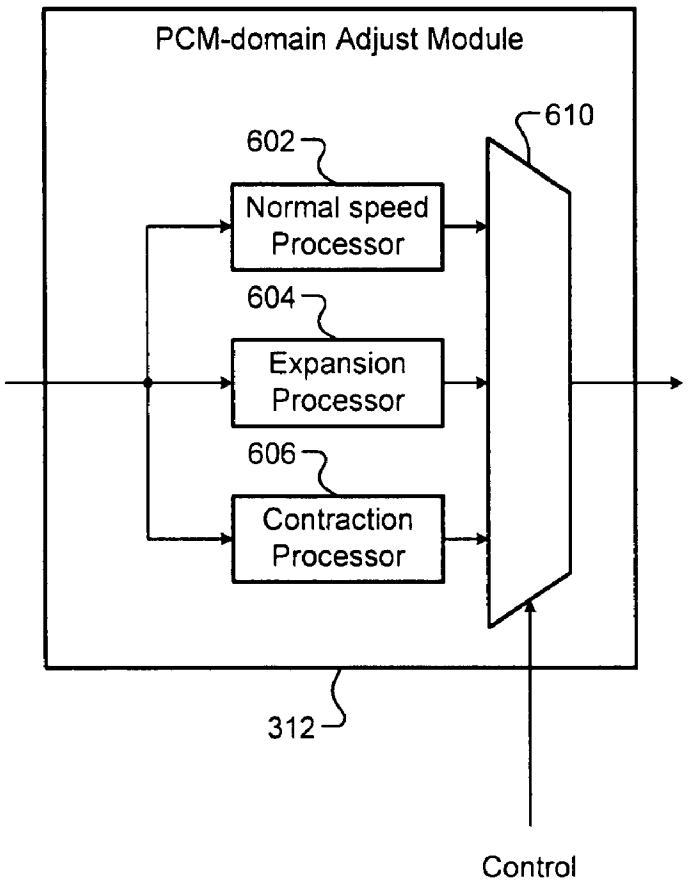
FIG. 6 is a functional block diagram of an exemplary implementation of the PCM-domain adjust module.

Referring now to FIG. 6, a functional block diagram of an exemplary implementation of the PCM-domain adjust module 312 is presented. The PCM-domain adjust module 312 includes a normal speed processor 602, an expansion (or slowing down) processor 604, and a contraction (speeding up) processor 606. The processors 602, 604, and 606 receive a PCM data stream, and output a PCM data stream to a multiplexer 610. The multiplexer 610 selects the output of one of the processors 602, 604, and 606, based on a control signal from the playout adjustment module 308.

For example, the normal speed processor 602 passes the PCM stream unaltered to the multiplexer 610. The expansion processor 604 inserts additional PCM samples into the PCM stream that is output to the multiplexer 610. Incoming PCM data may be classified as silent, voice data, or non-voice data. In addition, voice data may be subcategorized into stable voice data and unstable voice data.

Audio data may be classified as voice data based upon the rate of zero crossings of the audio signal. If the audio signal has a rate of zero crossings that is above a threshold, the audio may be considered to be non-voice data. The rate of zero crossings may be determined by counting the number of sign reversals in a segment of audio data. For voice data, the distinction between stable voice data and unstable voice data may be determined by the level of periodicity of the audio data.

The level of periodicity of the audio data may be determined by determining the period of a section of data, and comparing one period's worth of 0data from the section with an adjacent period's worth of data. For example, the comparison may include determining a correlation coefficient. For perfectly periodic signals, the correlation between the two adjacent periods of data will be 1.

The period may be determined by guessing and/or estimating a test period, and determining the level of periodicity corresponding to that test period. This may be performed for the range of all supported periods, and the test period leading to the greatest correlation is chosen as the actual period. If the correlation coefficient for the actual period is less than a threshold, the audio data may be considered to be unstable voice data.

The maximum supported period may be stored as a variable PITCHMAX, which may, for example, be 120 for 8 kHz PCM data. To test an audio signal for a 120 sample period, 240 samples are used. The first 120 are compared to the second 120, and the correlation value indicates whether 120 samples is a likely period of the audio data.

For non-voice data or for silent data, the expansion processor 604 may replicate samples to achieve a slowdown in playback. For example, each PCM sample may be output twice to achieve a two-times slowdown in audio data playout. For unstable voice data, the expansion processor 604 may output the unstable voice samples unchanged because of the difficulty in inaudibly expanding that data.

Figure 7A:
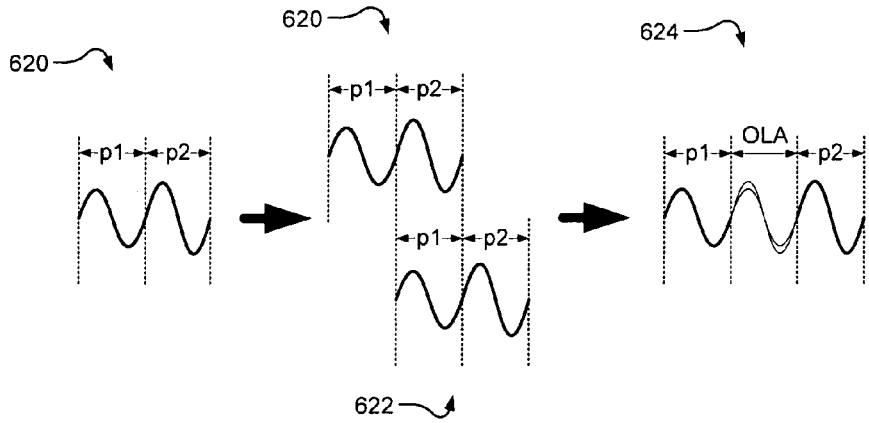
FIG. 7A is a graphical depiction of inserting a continuous cycle using overlap adding (OLA)
Figure 7B:
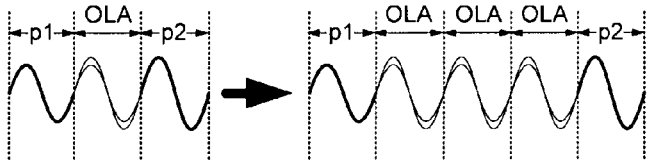
FIG. 7B is a graphical depiction of replicating the OLA segment.

For stable voiced data, one or more waveform periods may be inserted between each pair of received waveform periods. A waveform period may also be referred to as a cycle. Creation of cycles for insertion is shown in FIGS. 7A-7B. Instead of simply replicating the previous or subsequent cycle, the previous and subsequent cycles may be blended to produce a more continuous cycle. Multiple copies of the continuous cycle may then be inserted.

The contraction processor 606 characterizes the incoming audio data. For non-voice and silent data, the contraction processor 606 may output the PCM data unchanged. Non-voice data may be difficult to compress without audible defects, while silent periods may already have been removed by a silence interval adjust module. For stable or unstable voice data, two incoming cycles can be merged into one.

To vary the amount of speedup, the number of pairs of input cycles that are merged can be varied. For example, each pair of cycles may be merged. Alternatively, only two cycles out of every ten cycles may be merged. In addition, merged cycles may be merged with other merged cycles or with subsequent cycles to further increase the speedup of PCM data playout. For example, cycles 1 and 2 may be merged, cycles 3 and 4 may be merged, and the results may then be merged. Alternatively, cycles 1 and 2 may be merged, and the result merged with cycle 3.

Figure 7C:
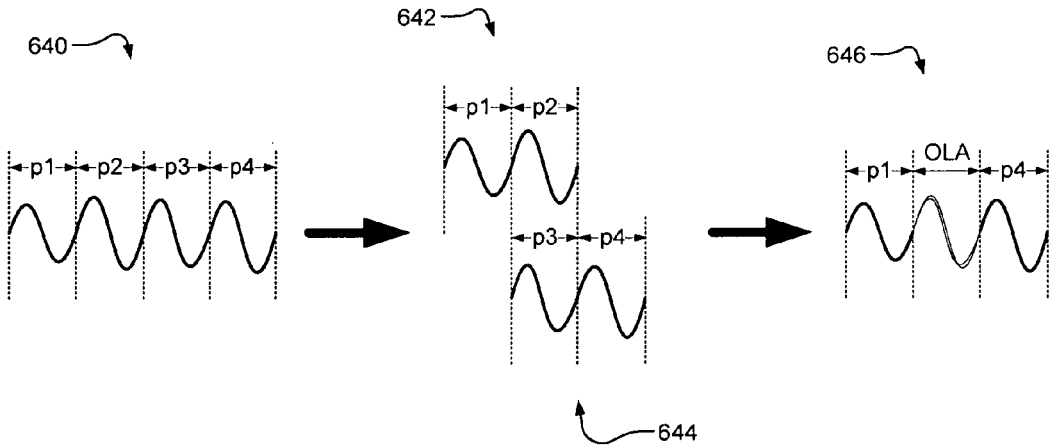
FIG. 7C is a graphical depiction of combining two cycles using OLA.

Merging of speed cycles is shown with respect to FIG. 7C. The multiplexer 610 then selects one of the PCM data streams from the processors 602, 604, and 606, and presents it for outputs from the integrated AJB/PLC module. For example only, only one of the processors 602, 604, and 606 may be active at a time based upon which will be used by the multiplexer 610.

Referring now to FIG. 7A, a graphical depiction of inserting a continuous cycle is presented. Two cycles, p1 and p2, of an exemplary waveform 620 are shown. The waveform 620 is shifted to produce a shifted waveform 622, which is combined with the waveform 620 to produce an expanded waveform 624. The waveform 620 and the shifted waveform 622 may be combined using a technique named Overlap Adding (OLA).

In overlap adding, one signal is faded in while the other is faded out. In the waveform 620, the right side of cycle p1 is continuous with cycle p2. Therefore, in order for the segment created by OLA to be continuous with cycle p1, the left side of the OLA segment should be very similar to the left side of the p2 segment. Similarly, the right side of the OLA segment should be very similar to the right side of the p1 segment.

As such, segments p2 and p1 can be combined to produce the OLA segment by fading out the p2 segment and fading in the p1 segment. These two faded segments can then be added to create the OLA segment. The fade-in and fade-out windows may add up to 1 over the length of the OLA segment. The fade-in and fade-out windows may also begin and end at either 0 or 1. The simplest form of fade-in and fade-out windows are triangular windows, such as those shown in FIG. 9A.

Referring now to FIG. 7B, a graphical depiction of replicating the OLA segment is shown. Originally, segments p1 and p2 were continuous. A properly created OLA segment is continuous to the left with p1 and to the right with p2. The OLA segment is therefore continuous with itself, meaning that the left side of the OLA segment would be continuous with the right side of the OLA segment.

The OLA segment is defined as OLA=p2*gain$_{fade\text{-}in}$+p1*gain$_{fade\text{-}in}$. The derivative of the OLA segment is therefore $$\frac{dOLA}{dt} = \frac{dp2}{dt} * gain_{fade-out} + \frac{dp1}{dt} * gain_{fade-in},$$

where the derivative at the start and end of the OLA segment is:

$$\begin{cases} \frac{dOLA}{dt}(t_{start}) = \frac{dp2}{dt}(t_{start}) \\ \frac{dOLA}{dt}(t_{end}) = \frac{dp1}{dt}(t_{end}) \end{cases}$$

Because p1 and p2 are continuous, $$\frac{dp2}{dt}(t_{start}) = \frac{dp1}{dt}(t_{end}).$$

Therefore, the derivative at the start and the end of the OLA segment are equal:

$$\frac{dOLA}{dt}(t_{start}) = \frac{dOLA}{dt}(t_{end}).$$

The transition from one OLA section's tail to next OLA section's head is therefore continuous. Because of this, multiple OLA segments can be inserted in between the received p1 and p2 segments. The number of OLA segments inserted and how often they are inserted is controlled by the expansion processor 604.

In FIG. 7C, a graphical depiction of combining two cycles into one is shown. Four cycles, p1, p2, p3, and p4, of an exemplary waveform 640 are shown. Cycles p2 and p3 can be combined using an Overlap Add (OLA). A partial waveform 642 composed of cycles p1 and p2 may therefore be overlapped with a partial waveform 644 composed of cycles p3 and p4.

To ensure that the left side of the OLA segment is continuous with the right side of p1, a fade-out window is applied to p2. To ensure that the right side of the OLA segment is continuous with the left side of p4, a fade-in window is applied to p3. The faded-out p2 and the faded-in p3 are then added to produce the OLA segment, shown as part of an output waveform 646. The continuity of the OLA segment can be mathematically proven as demonstrated above.

Further combining operations may be performed, such as between the OLA segment and p1 or p4. Alternatively, cycles p4 and p5 (not shown) may be combined using OLA. The two OLA segments may then be combined again using OLA. The amount of OLA combining performed is determined by the contraction processor 606.

Figure 8:
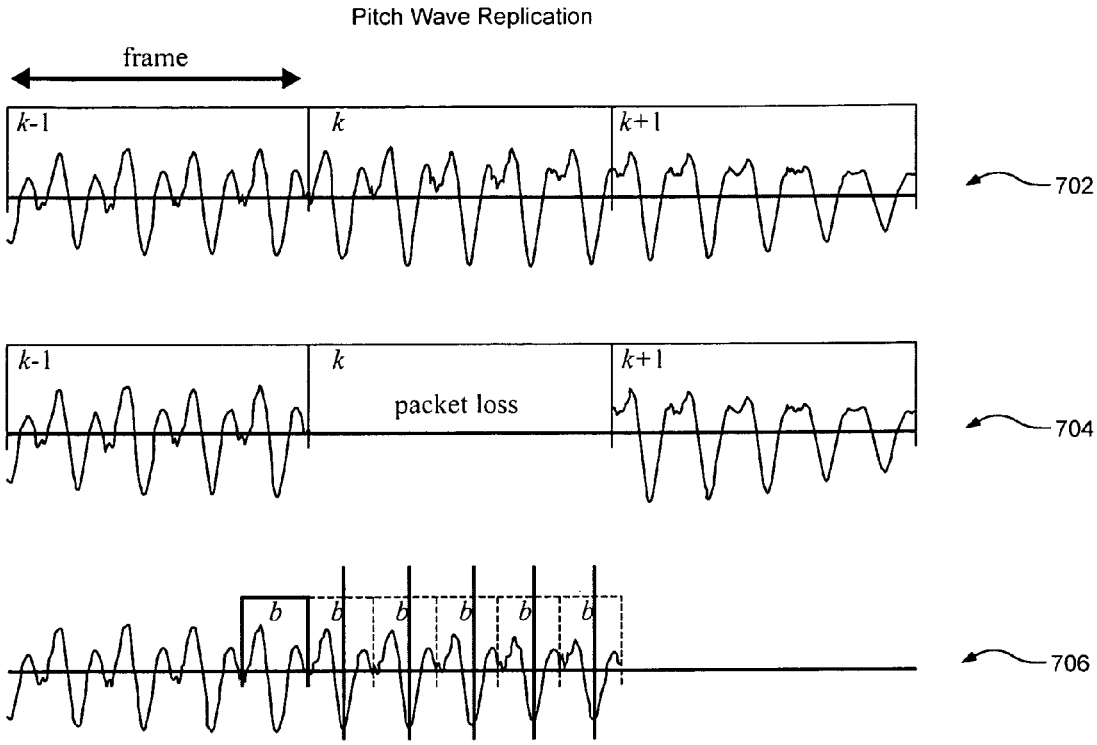
FIG. 8 is a graphical depiction of pitch wave replication (PWR) to recover the contents of a lost packet.

Referring now to FIG. 8, a graphical depiction of pitch wave replication (PWR) to recover the contents of a lost packet is shown. An original waveform 702 having three frames is shown. The waveform 702 may have been created from the output of a microphone attached to a remote phone. Each frame may be transmitted over a network using a separate packet. As received, a waveform 704 may be missing the middle of the three frames of the waveform 702.

Figure 9A:
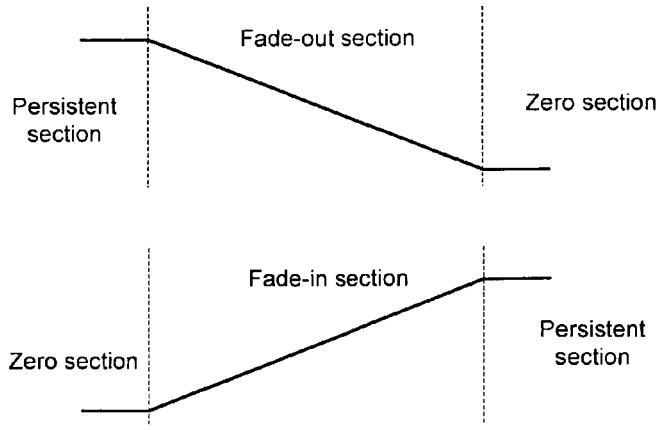
FIG. 9A is a graphical depiction of windowing functions for bidirectional PWR.
Figure 9B:
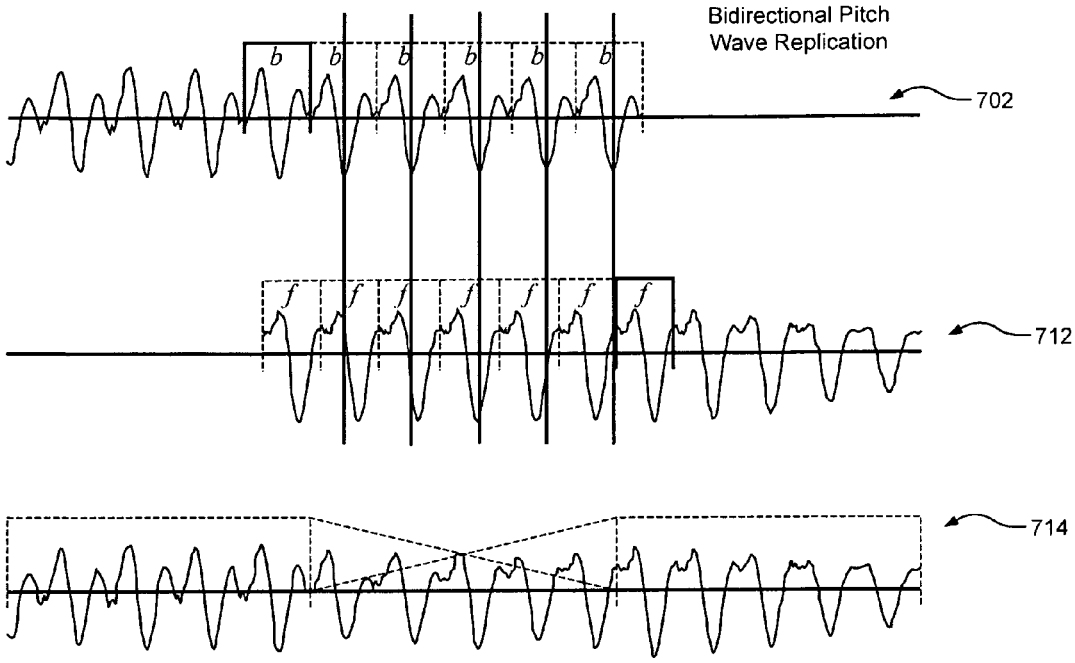
FIG. 9B is a graphical depiction of bidirectional PWR.

In PWR, the last waveform period (or pitch wave) of the frame preceding the gap is replicated. Waveform 706 depicts the last cycle of the first frame being replicated along the length of the missing second frame to conceal its loss. However, the second frame may not have contained a repeating cycle. In addition, the replicated pitch wave may not be continuous with the third frame. FIGS. 9A and 9B show approaches for minimizing these problems.

Referring now to FIG. 9A, PWR may be performed bidirectionally—in both a forward and a reverse direction. The forward replication may be faded out toward the end of the missing section, while the backward replication may be faded out toward the beginning of the missing section. In this way, the beginning of the missing section is continuous with the preceding frame, while the end of the missing section is continuous with the following frame. Bidirectional PWR therefore uses overlap adding, as discussed above with respect to FIGS. 7A-7C. However, bidirectional PWR performs an OLA across an entire frame or longer, while the OLA shown in FIGS. 7A-7C is used on pairs of pitch waves.

FIG. 9B is a graphical representation of the results of bidirectional PWR. A waveform 710 shows that the last pitch wave (period) of the preceding frame is replicated in a forward direction. A waveform 712 shows that the first pitch wave of the subsequent frame is replicated in a rearward direction. A fade-out window is applied to the waveform 710 and a fade-in window is applied to the waveform 712 to produce a waveform 714.

Figure 10:
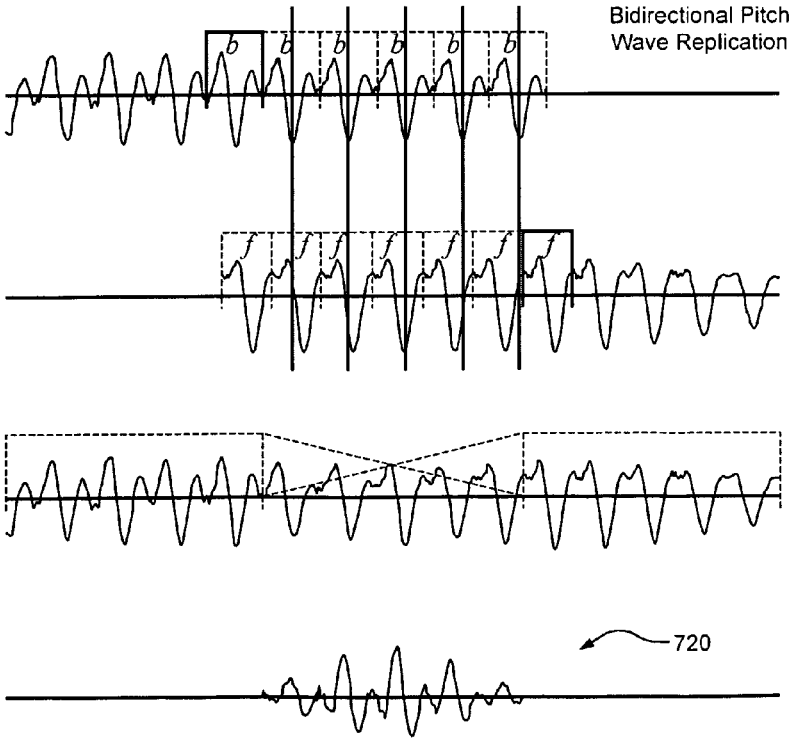
FIG. 10 is a graphical depiction of the bidirectional PWR of FIG. 9B along with a phase error signal.

Referring now to FIG. 10, the bidirectional PWR of FIG. 9B is shown along with a phase error signal 720. Bidirectional PWR recognizes that the frames before and after the gap may have different waveforms, and therefore blends one into another. However, it is possible for the frequency of audio data to change during the gap. This change in frequency may result in a phase error, shown at 720, when bidirectional PWR is used.

Figure 11A:
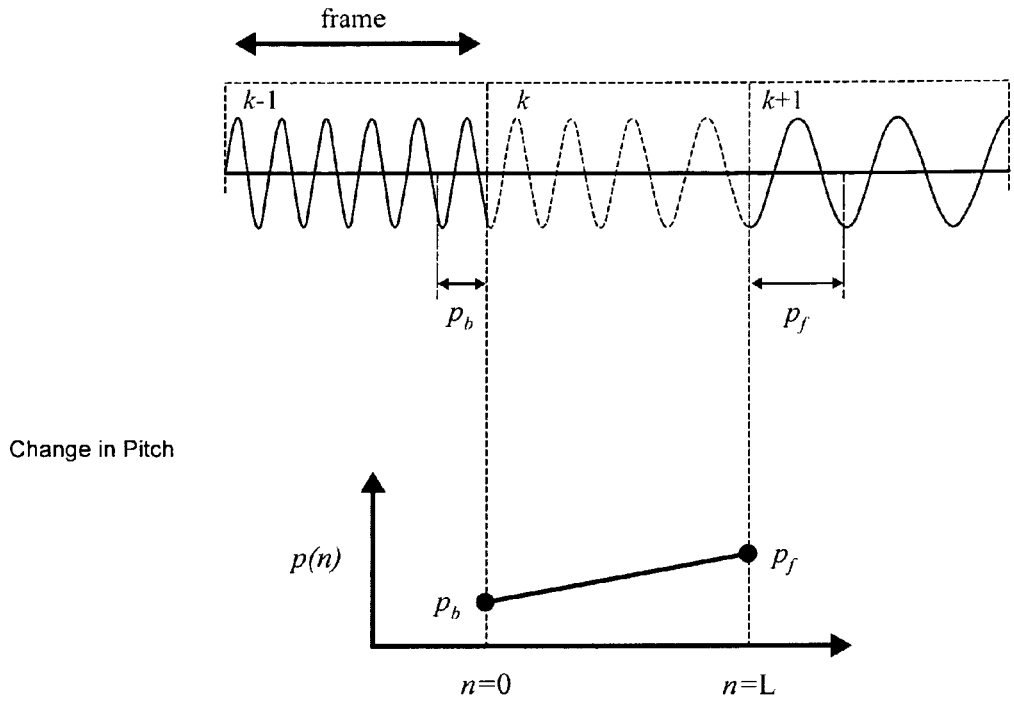
FIG. 11A is a graphical depiction of three frames where the pitch (period) changes during the middle frame.

Referring now to FIG. 11A, a graphical depiction of three frames where the pitch (period) changes during the middle frame is shown. The middle frame may be the one lost in transmission. In the middle frame, the pitch increases from the left end to the right end. A forward PWR should therefore gradually increase the pitch of the forward-propagated pitch wave, while a backward PWR should gradually decrease the pitch of the backward-propagated pitch wave. A pitch change ratio may be defined by dividing the pitch immediately to the right of the right side of the middle frame by the pitch immediately to the left of the left side of the middle frame.

Figure 11B:
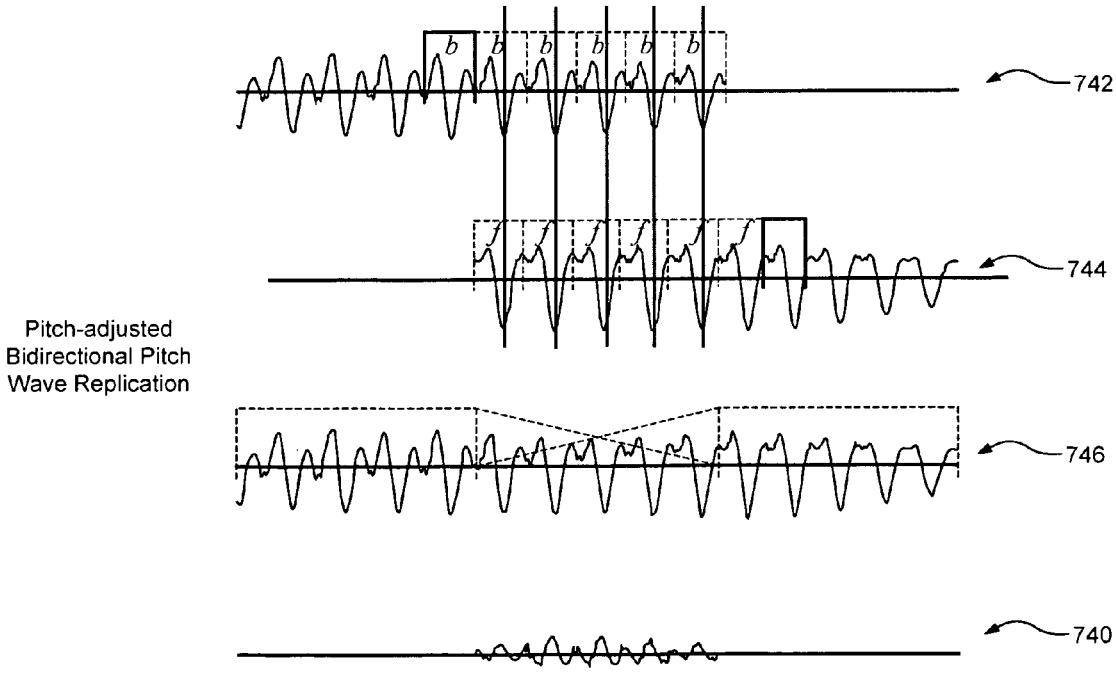
FIG. 11B is a graphical depiction of pitch-adjusted bidirectional PWR.

Referring now to FIG. 11B, a graphical depiction of pitch-adjusted bidirectional PWR is shown. By adjusting for changes in pitch, a resulting phase error waveform 740 may be reduced. A forward PWR that incrementally increases the pitch of each propagated pitch wave is shown at 742. The change in pitch may be assumed to be linear from one end of the missing frame to the other.

Other transition functions, such as exponential, may also be used. However, these may require additional processing power. A less computationally intensive function may be used, such as one that is based on a Taylor series expansion of the exponential. Such a function is shown with respect to FIG. 14. Reverse PWR, as shown at 744, decreases in pitch from the right to the left. Overlap adding the waveforms 742 and 744 produces a pitch-adjusted bidirectional PWR waveform 746. The resulting phase error waveform 740 is less than that when pitch adjustment is not used, as shown in FIG. 10 at 720.

Figure 12:
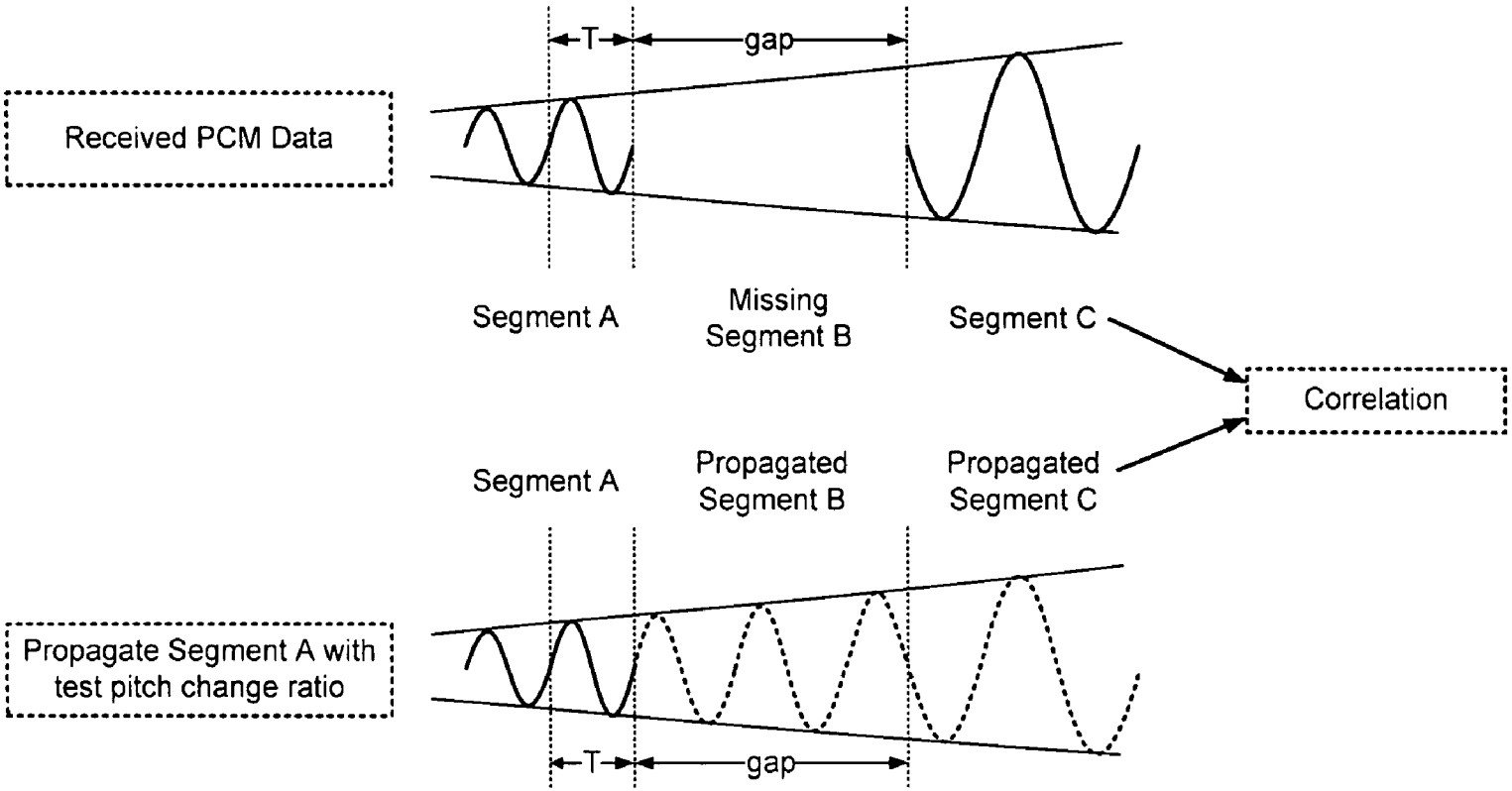
FIG. 12 is a graphical depiction of pitch change ratio determination.

Referring now to FIG. 12, a graphical depiction of the determination of the appropriate pitch change ratio is presented. Segments A and C have been received. However, segment B is missing, creating a gap between segments A and C. The pitch at the right side of segment A is determined to be T.

The pitch change ratio may be determined through trial and error. A test pitch change ratio is used to propagate the rightmost cycle of segment A throughout the missing segment B and into the area of segment C. If the portion of segment C as propagated from segment A has a high correlation to the actual received segment C, the test pitch change ratio is likely correct.

Pitch change ratios may be evaluated within a range, such as between approximately 0.5 and 2.0. In other words, it may be assumed that the pitch does not change, either higher or lower, by more than a factor of 2. The pitch change ratio may first be tested at 1.0, and then alternately increased above 1.0 and decreased below 1.0 when searching for the best pitch change ratio. The pitch change ratio resulting in the highest correlation between the propagated segment C and the actual received segment C is chosen as the pitch change ratio for pitch adjusted pitch wave replication.

Experimentally determining the pitch change ratio may produce more accurate results than simply determining the pitch of segment A and determining the pitch of segment C and dividing the two. This is because the determined pitch of either segment A or segment C may be incorrect. For example, one period determined for segment C may actually include multiple waveforms, each of which might be a period in segment A.

Figure 13A:
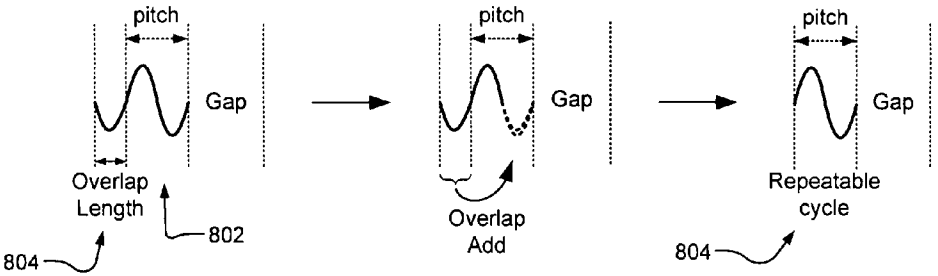
FIG. 13A is a graphical depiction of creating a repeatable cycle for PWR in the forward direction.
Figure 13B:
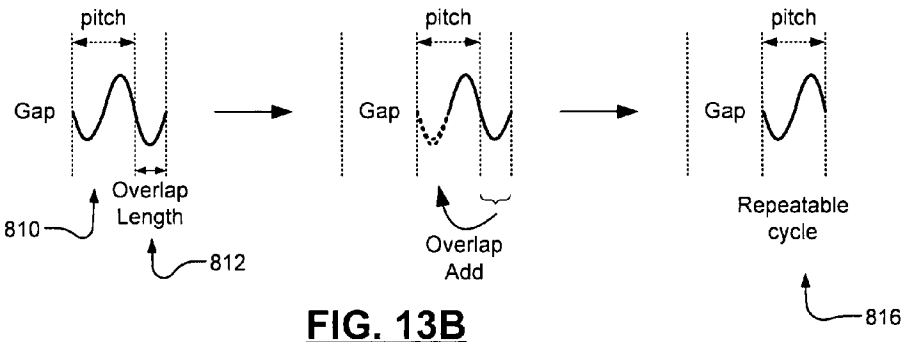
FIG. 13B is a graphical depiction of creating a repeatable cycle for PWR in the backward direction.

Referring now to FIGS. 13A-13B, PWR may be further improved by ensuring that the pitch cycle used for replication is continuous from its left side to its right side. In this way, as the pitch cycle is repeated, the junction between the repeated pitch cycles will be continuous. In other words, the actual values will be equal at each end of the pitch cycle, as will the derivatives.

FIG. 13A graphically depicts how the pitch cycle that will be propagated in the forward direction is made continuous. A pitch cycle 802 is identified immediately prior to the gap created by the missing frame(s). The length of the pitch cycle 802 may be determined by searching for a most descriptive pitch, as detailed above with respect to FIG. 6.

A segment of data immediately preceding the pitch cycle 802 is continuous with the left side of the pitch cycle 802. If the segment is overlap added to the right side of the pitch cycle 802, the right side of the pitch cycle 802 will be continuous with the left side of the pitch cycle 802. The segment 804 is therefore right-aligned to the pitch cycle 802 and overlap added with the pitch cycle 802. The segment 804 is faded in, while the right side of the pitch cycle 802 is faded out. This produces a repeatable cycle 806.

The repeatable cycle 806 can then be replicated while taking into account the pitch change ratio, which may be determined according to FIG. 12. The overlap length may be defined to be 20 samples long when the maximum supported pitch is 120. Alternatively, the overlap length may be determined based on the pitch of the pitch cycle 802. For example, the overlap length may be one-fifth of the length of the pitch cycle 802.

FIG. 13B graphically depicts creating a repeatable cycle from a pitch cycle 810 to the right of the gap created by the missing frame(s). A segment 812 immediately following the pitch cycle 810, whose length is defined by the overlap length, is overlap added to the left side of the pitch cycle 810. A resulting repeatable cycle 816 is thereby produced. The repeatable cycle 816 can then be propagated in the backward direction using the inverse of the pitch change ratio, which may be determined according to FIG. 12.

Figure 14:
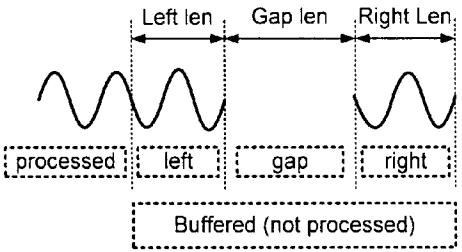
FIG. 14 is a graphical depiction of a buffer storing waveform data to the left of a gap, to the right of the gap, and data created to fill the gap.

Referring now to FIG. 14, a buffer may store waveform data to the left of the gap, waveform data to the right of the gap, and waveform data created to fill the gap. The length of the left buffer may be determined by twice the maximum pitch length plus the overlap length corresponding to that maximum pitch length.

Twice the maximum pitch length may be used to determine the pitch of the waveform data to the left of the gap. Once the pitch has been determined, the size of the left buffer can be reduced to the actual pitch plus the overlap length corresponding to the actual pitch. The excess data can then be output. Once a repeatable cycle is generated, such as shown in FIG. 13A, using the samples in the overlap length region, the length of the left buffer can be further shortened to only store the repeatable cycle.

If the left buffer is not further changed by bidirectional PWR, the data in the left buffer may be output while bidirectional PWR is being performed. Once the gap has been filled in, the gap buffer and the right buffer can be output as needed. The repeatable pitch cycle may be stored as pitch(n), $0 \leqq n < T$, where T is the pitch (in samples) of the repeatable pitch cycle.

For PWR that is not pitch-adjusted, the propagated waveform may be constructed using f(n)=pitch(n mod T), $n \geqq 0$. For pitch-adjusted PWR, the propagated waveform may be constructed using g(n)=f(s(n)), where s(n) is the scaling function. The scaling function may be defined to comply with a set of requirements, such as s(0)=0, $$\left.\frac{dg(n)}{dn}\right|_{n=0} = \left.\frac{df(n)}{dn}\right|_{n=0}.$$

In other words, f'(s(0))s'(0)=f'(0). This implies that s'(0)=1. For the inverse function for backward propagation, $p(t)=s^{-1}(t)$, similar requirements may be defined: p(0)=0, p'(0)=1.

Human speech tone changes based on an exponential scale and the human hearing system also functions using an exponential scale. A choice for the scaling function s(t) may therefore use an exponential form. To simplify the computational requirements of the exponential, a scaling function such as $$s(t) = t + \frac{kt^2}{2}$$

may be used, which may be based on Taylor series expansion of the exponential. The derivative is therefore s'(t)=1+kt. The function used for forward propagation is then:

$$g(t) = f(s(t)) = f\left(t + \frac{kt^2}{2}\right).$$

In terms of samples, the function may be $$f(n) = \text{pitch}\left(\left[n + \frac{kn^2}{2}\right] \bmod T\right),\ n \geq 0.$$

If the phase at the beginning of the gap is defined to be 0, the phase at the end of the gap, $phase_{gap}$, is also the change in phase throughout the gap. The pitch at the beginning of the gap is labeled T, and the pitch cycle after the gap is labeled T'. The length of the gap (in samples) is $L_{gap}$. The value of k may be mathematically derived as follows:

$$\begin{cases} Phase_{gap} = L_{gap} + \dfrac{kL_{gap}^2}{2} \\ Phase_{gap} + T = (L_{gap} + T') + \dfrac{k(L_{gap} + T')^2}{2} \end{cases} \Rightarrow k = \frac{T - T'}{(T' + 2L_{gap})T'}$$

Figure 15:
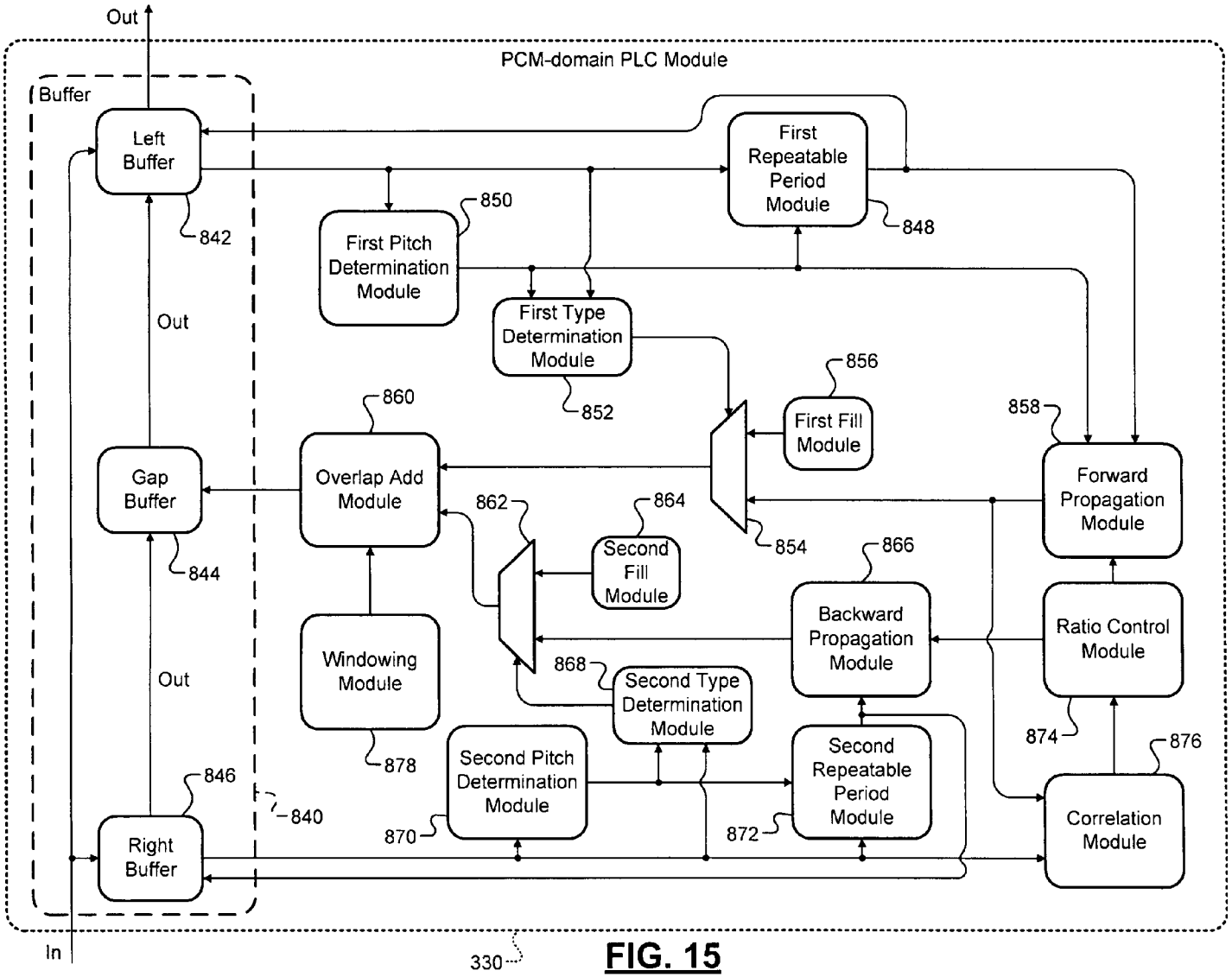
FIG. 15 is a functional block diagram of an exemplary implementation of a PCM-domain PLC module.

Referring now to FIG. 15, a functional block diagram of an exemplary implementation of the PCM-domain PLC module 330 is presented. The PCM-domain PLC module 330 includes a buffer 840. The buffer 840 includes a left buffer 842, a gap buffer 844, and a right buffer 846. The buffers 842, 844, and 846 store data as shown in FIG. 14. The left buffer 842 stores data before a gap, while the right buffer 846 stores data after the gap. The gap buffer 844 stores reconstructed audio data.

Data in the left buffer 842 and the right buffer 846 may be modified as the gap buffer 844 is being filled. For example, the left buffer 842 may store data from a first repeatable period module 848, which converts a period of data from the left buffer 842 into a period that is continuous between its left and right ends. Data from the left buffer 842 may be output once data in the left buffer 842 has been updated by the first repeatable period module 848.

Data from the gap buffer 844 can be output once it has been filled. Finally, data from the right buffer 846 may be read. While FIG. 15 shows data being shifted through the left buffer 842, the gap buffer 844, and the right buffer 846, may be read in any suitable manner. In other words, the buffer 840 may include shift registers and/or random access registers.

The first repeatable period module 848 receives a pitch signal from a first pitch determination module 850. The first pitch determination module 850 receives data from the left buffer 842. In various implementations, the left buffer 842 may be sized to include two times the maximum supported pitch plus the overlap length for the maximum supported pitch.

The first pitch determination module 850 determines the pitch (or period) of the right-most data in the left buffer 842. This may be done by testing the level of periodicity for a range of test period lengths. The test period length that results in the highest level of periodicity may be considered to be the period of the data. The level of periodicity may be determined by performing a correlation between the right-most section of the left buffer 842 and an adjacent section of the left buffer 842.

The lengths of these two sections are equal to the period length being tested. If the period length being tested is the actual period of the data, the correlation will generate a high level of periodicity (correlation coefficient) because two periods of a periodic signal are being compared. The first pitch determination module 850 outputs the pitch that was determined to have the highest level of periodicity.

The first type determination module 852 receives the pitch signal, and may also receive the level of periodicity determined for that pitch signal. The first type determination module 852 may also receive data from the left buffer 842. The first type determination module 852 may determine whether the data stored in the left buffer 842 is other than voice data by performing a zero crossing analysis.

If the number of zero crossings of the data within a given number of audio samples is greater than a threshold, the first type determination module 852 may determine that the data is other than voice data. The first type determination module 852 may also determine whether voice data is stable or unstable. For example, the first type determination module 852 may determine that voice data is stable when the level of periodicity corresponding to the pitch from the first pitch determination module 850 is greater than a threshold.

Based on whether the data is non-voiced, stable voiced, or unstable voiced, the first type determination module 852 controls a first multiplexer 854. The first multiplexer 854 receives inputs from a first fill module 856 and a forward propagation module 858. The first multiplexer 854 may select the first fill module 856 when the audio data in the left buffer 842 is not voice data.

When the data is voice data, the first multiplexer 854 may select data from the forward propagation module 858. The output of the first multiplexer 854 is received by an overlap add module 860, which combines a forward waveform from the first multiplexer 854 with a backwards waveform from a second multiplexer 862. The overlap add module 860 outputs the result to the gap buffer 844.

The second multiplexer 862 receives inputs from a second fill module 864 and a backward propagation module 866. The second fill module 864 may function similarly to the first fill module 856. The first and second fill modules 856 and 864 may provide zero (or silent) samples and/or white noise samples. The second multiplexer 862 is controlled by a second type determination module 868. The second type determination module 868 receives values from the right buffer 846 and from a second pitch determination module 870.

The second pitch determination module 870 may function similarly to the first pitch determination module 850. The second pitch determination module 870 also outputs pitch information to a second repeatable period module 872. The second repeatable period module 872 converts data from the right buffer 846 into a repeatable period that is continuous between its right and left ends, as shown in FIG. 13B.

The output of the second repeatable period module 872 is transmitted to the backward propagation module 866, and may also be stored back into the right buffer 846. The second multiplexer 862 may select the second fill module 864 when the second type determination module 868 determines that the left-most data in the right buffer 846 is not voice data.

The forward propagation module 858 and the backward propagation module 866 are controlled by a ratio control module 874. The ratio control module 874 may determine the ratio between the pitch in the right buffer 846 to the pitch in the left buffer 842. The ratio control module 874 may perform trial and error with a range of ratios. The ratio control module 874 may provide a test ratio to the forward propagation module 858.

The forward propagation module 858 performs a forward propagation on the repeatable period from the first repeatable period module 848. The length of the propagation is determined by the gap length. The repeatable period is propagated until it would overlap with the data in the right buffer 846. It is then compared to the data stored in the right buffer 846 by a correlation module 876. If there is a high correlation determined by the correlation module 876, the test ratio is likely correct.

The ratio control module 874 may iterate through a range of possible ratios to determine the ratio having the best correlation. If the best correlation determined is still less than the threshold value, the ratio control module 874 may use a default pitch ratio of 1.0. In this case, the forward and backward propagation modules 858 and 866 will not change the ratio of the repeatable periods as they are propagated.

The ratio chosen by the ratio control module 874 is output to the backward propagation module 866, which backward propagates the repeatable period from the second repeatable period module 872 through the gap region. Assuming that the first and second multiplexers 854 and 862 have selected the forward propagation module 858 and the backward propagation module 866, respectively, the forward and backward propagated waveforms are then added using the overlap add module 860.

The overlap add module 860 uses windows defined by a windowing module 878. For example, the windowing module 878 may store a fade-out window for the output of the first multiplexer 854 and a fade-in window for the output of the second multiplexer 862. The fade-out window may begin at one and end at zero, while the fade-in window may begin at zero and end at one. For example, the fade-in and fade-out windows may be triangles. The ratio control module 874 may modify the windows stored in the windowing module 878 and/or may select from multiple predefined windows. For example, if the highest correlation determined by the ratio control module 874 is above a threshold, the ratio control module 874 may select windows within the windowing module 878 that overlap each other to a greater extent.

Figure 16:
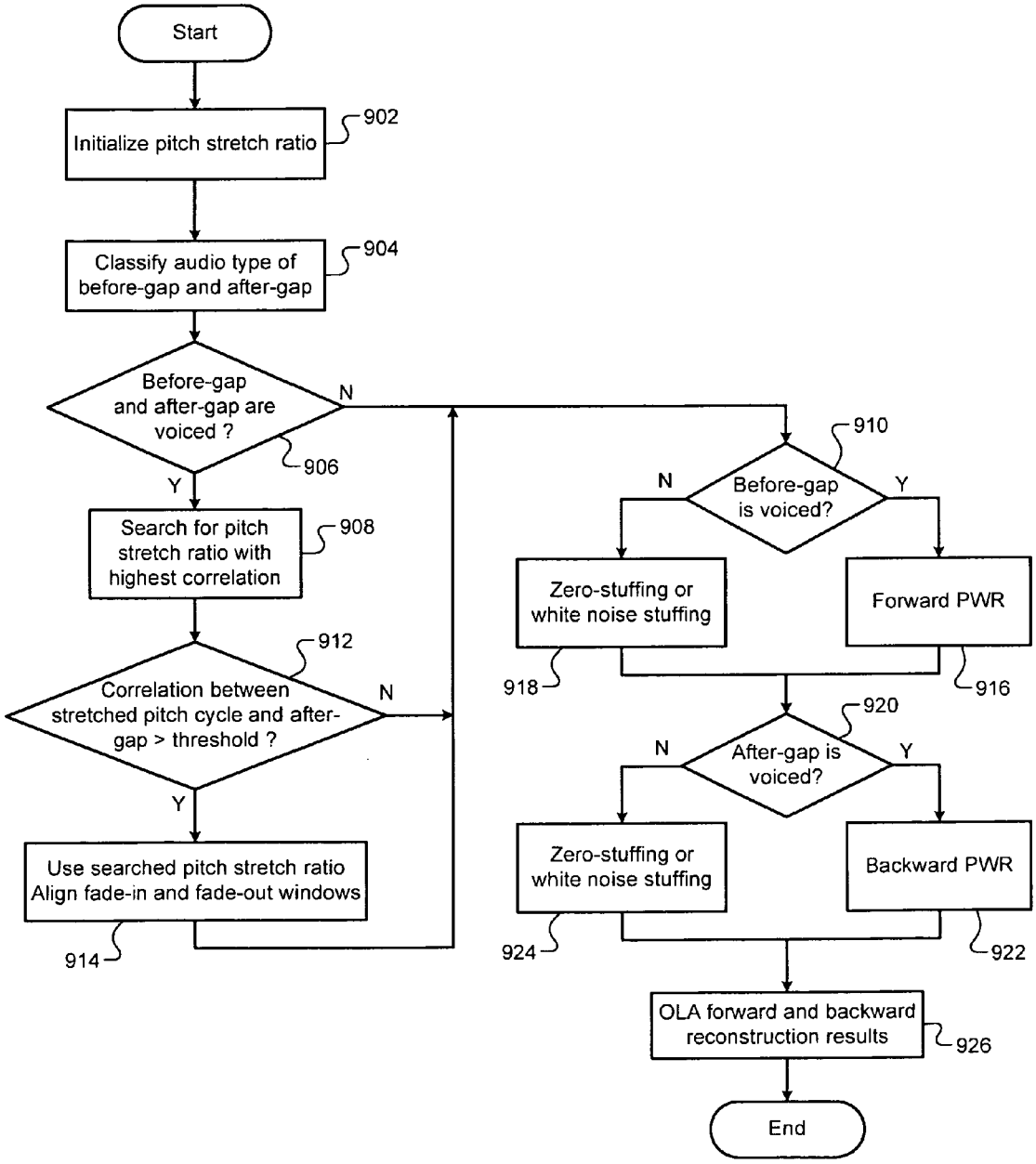
FIG. 16 is a flowchart depicting exemplary steps performed by the PCM-domain PLC module.

Referring now to FIG. 16, a flowchart depicts exemplary steps performed by the PCM-domain PLC module 330. The steps performed herein are used when a packet is missing. For times when packets are not missing, packet loss concealment is unnecessary, and PCM data can be output unchanged. Control begins in step 902, where a pitch-stretch ratio is initialized, such as a value of 1.0.

Control continues in step 904, where control classifies the type of audio in the region before a gap and in the region after the gap. In step 906, if the data in the before-gap and after-gap regions are voice data, control transfers to step 908; otherwise, control transfers to step 910. In step 908, control searches for the pitch change ratio with the highest correlation, which may be performed as described with respect to FIG. 12.

In step 912, control determines whether the correlation for the identified pitch change ratio is greater than a threshold. If so, control transfers to step 914; otherwise, control transfers to step 910. In step 914, control determines to use the identified pitch change ratio with the highest correlation as the pitch stretch ratio for PWR. Control also aligns the fade-in and fade-out windows. For example, with a high correlation, more overlap may be created between the fade-in and fade-out windows.

Control then continues in step 910. In step 910, control determines whether the before-gap audio data is voice data. If so, control transfers to step 916; otherwise, control transfers to step 918. In step 916, control performs forward PWR using the selected pitch change ratio to create a forward waveform. Forward PWR may use a repeatable cycle from the left buffer, which may be created as shown in FIG. 13A. Control then continues in step 920.

In step 918, control uses zeros (silence) or white noise as the forward waveform. Control then continues in step 920. In step 920, control determines whether the after-gap audio data is voice data. If so, control transfers to step 922; otherwise, control transfers to step 924. In step 922, control performs backward PWR using the inverse of the selected pitch change ratio to create a backward waveform.

Backward PWR uses a repeatable cycle, which may be determined as shown in FIG. 13B. Control then continues in step 926. In step 924, control uses zeros (silence) or white noise as the backward waveform. Control then continues in step 926. In step 926, an overlap add is performed between the forward and backward waveforms. The results from the overlap add is used to fill in the gap.

Figure 17:
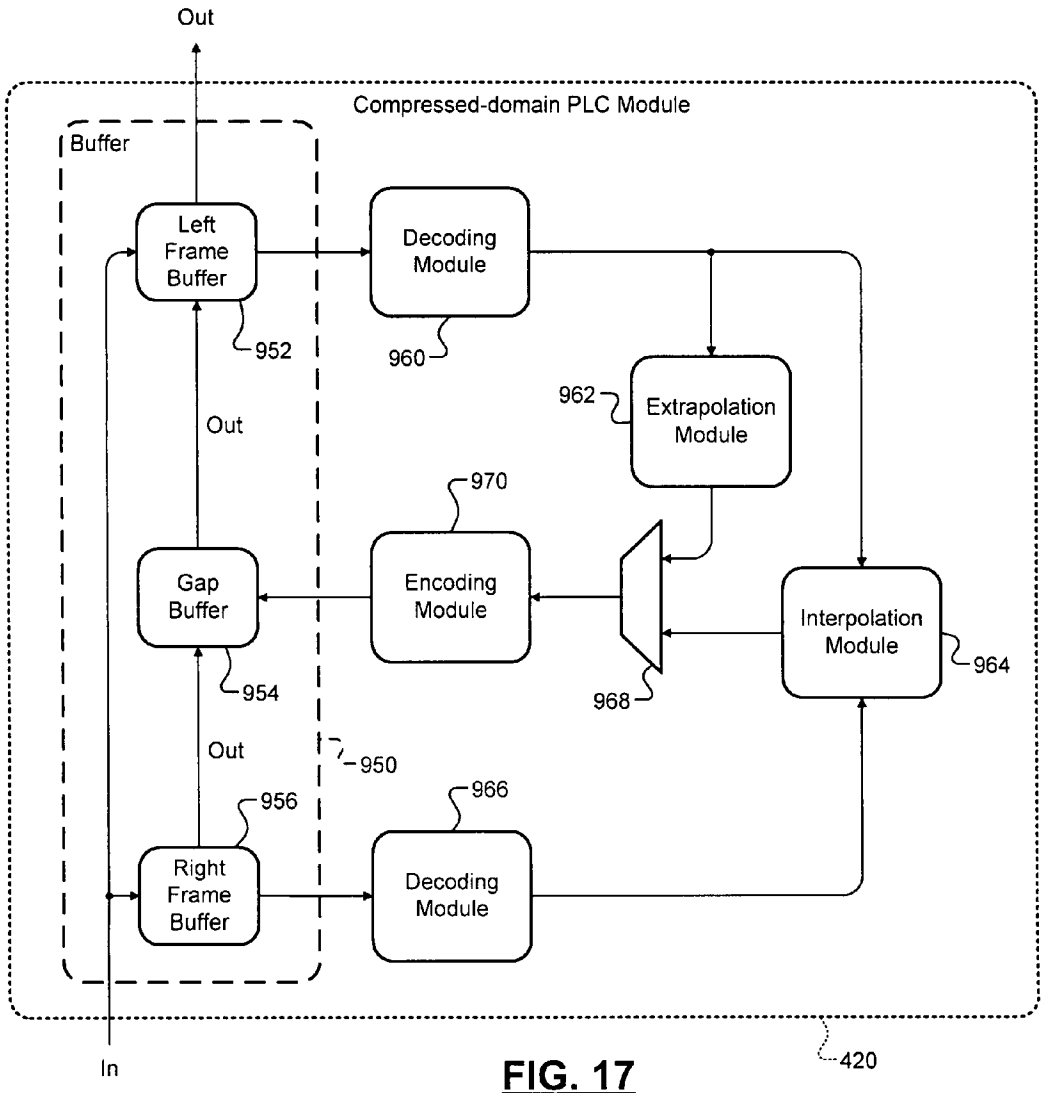
FIG. 17 is a functional block diagram of an exemplary implementation of a compressed-domain PLC module.

Referring now to FIG. 17, a functional block diagram of an exemplary implementation of the compressed-domain PLC module 420 of FIG. 4 is presented. The compressed-domain PLC module 420 includes a buffer 950, which includes a left frame buffer 952, a gap buffer 954, and a right frame buffer 956.

The buffer 950 may store frames, such as those defined by ITU-T G.729 and/or ITU-T G.723. Each frame may store model parameters used in recreating audio data. A first decoding module 960 decodes a frame stored in the left frame buffer 952. The extracted model parameters are output to an extrapolation module 962 and an interpolation module 964. Similarly, a second decoding module 966 decodes a frame stored in the right frame buffer 956. Model parameters from the decoded frame are output to the interpolation module 964.

The interpolation module 964 may interpolate, for each parameter, between the value that parameter has in the frames on either side of the gap. Each of these parameters is then passed to a multiplexer 968. The multiplexer 968 may select the output of the interpolation module 964 when a frame is available both before and after a gap. Otherwise, the multiplexer 968 may select an output of the extrapolation module 962, such as when a frame is only available prior to the gap.

The extrapolation module 962 may extrapolate from one or more previous frames. For example, for each parameter, the extrapolation module 962 may fit a line and/or curve to the previous values of the parameters from previous frames to determine the parameter value to be used for the missing frame. An output of the multiplexer 968 is output to an encoding module 970. The encoding module 970 encodes the parameters received from the multiplexer 968 back into an encoded frame. The encoded frame is stored in the gap buffer 954. The frames stored in the left frame buffer 952, the gap buffer 954, and the right frame buffer 956 are then decoded in series by a frame dependent coder, such as the frame dependent coder 410 of FIG. 4.

Figure 18B:
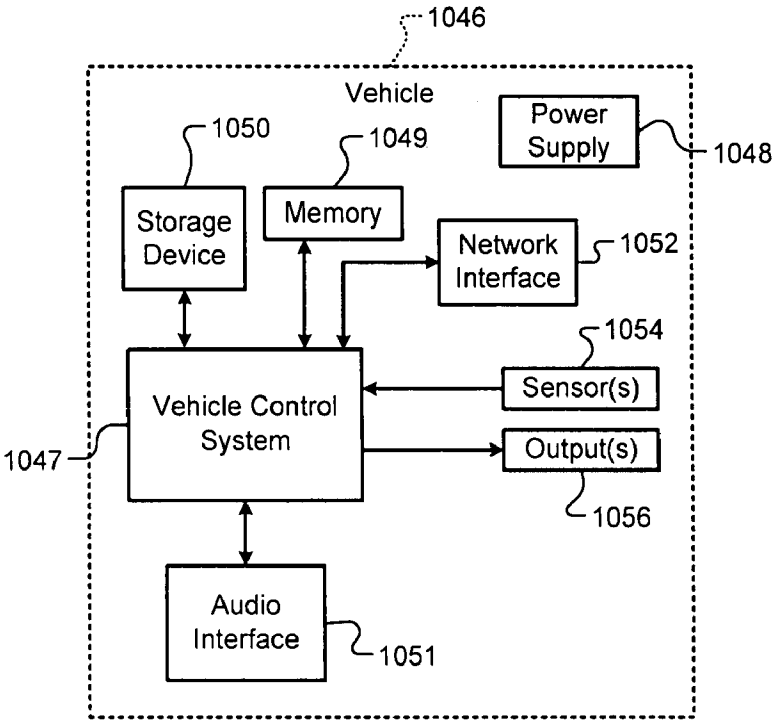
FIG. 18B is a functional block diagram of a vehicle control system.
Figure 18A:
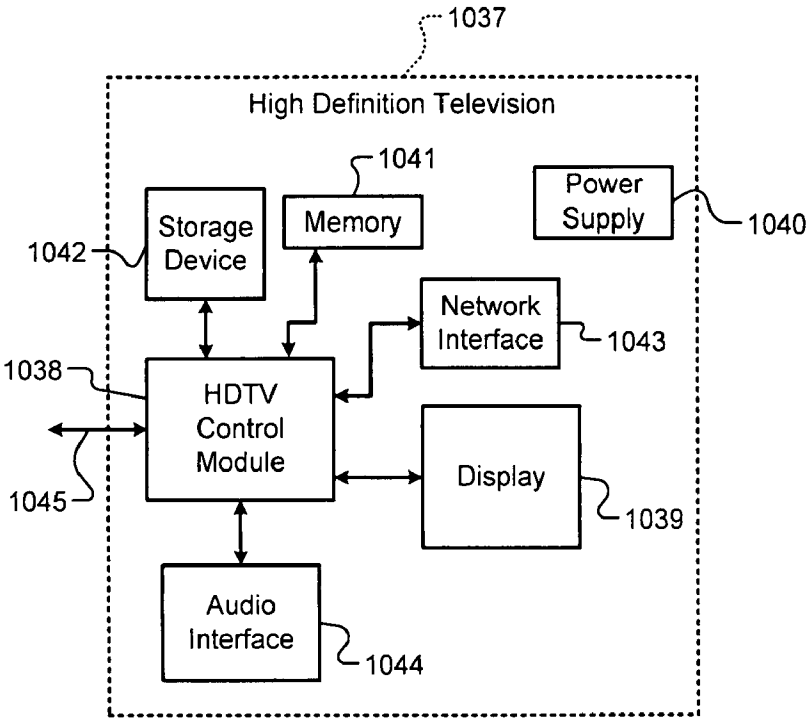
FIG. 18A is a functional block diagram of a high definition television.

Referring now to FIGS. 18A-18E, various exemplary implementations incorporating the teachings of the present disclosure are shown. Referring now to FIG. 18A, the teachings of the disclosure can be implemented in an audio interface 1044 of a high definition television (HDTV) 1037. The HDTV 1037 includes an HDTV control module 1038, a display 1039, a power supply 1040, memory 1041, a storage device 1042, a network interface 1043, and an external interface 1045. If the network interface 1043 includes a wireless local area network interface, an antenna (not shown) may be included.

The HDTV 1037 can receive input signals from the network interface 1043 and/or the external interface 1045, which can send and receive data via cable, broadband Internet, and/or satellite. The HDTV control module 1038 may process the input signals, including encoding, decoding, filtering, and/or formatting, and generate output signals. The output signals may be communicated to one or more of the display 1039, memory 1041, the storage device 1042, the network interface 1043, and the external interface 1045.

Memory 1041 may include random access memory (RAM) and/or nonvolatile memory. Nonvolatile memory may include any suitable type of semiconductor or solid-state memory, such as flash memory (including NAND and NOR flash memory), phase change memory, magnetic RAM, and multi-state memory, in which each memory cell has more than two states. The storage device 1042 may include an optical storage drive, such as a DVD drive, and/or a hard disk drive (HDD). The HDTV control module 1038 communicates externally via the network interface 1043 and/or the external interface 1045. The power supply 1040 provides power to the components of the HDTV 1037.

The audio interface 1044 may include a microphone and a speaker. The audio interface 1044 may also include an integrated adaptive jitter buffer and packet loss concealment module according to the principles of the present disclosure. VoIP packets may be received by the network interface 1043 and passed to the audio interface 1044. The integrated AJB/PLC module may decode audio data included in the VoIP packets and pass the data to the speaker.

Referring now to FIG. 18B, the teachings of the disclosure may be implemented in an audio interface 1051 of a vehicle 1046. The vehicle 1046 may include a vehicle control system 1047, a power supply 1048, memory 1049, a storage device 1050, and a network interface 1052. If the network interface 1052 includes a wireless local area network interface, an antenna (not shown) may be included. The vehicle control system 1047 may be a powertrain control system, a body control system, an entertainment control system, an anti-lock braking system (ABS), a navigation system, a telematics system, a lane departure system, an adaptive cruise control system, etc.

The vehicle control system 1047 may communicate with one or more sensors 1054 and generate one or more output signals 1056. The sensors 1054 may include temperature sensors, acceleration sensors, pressure sensors, rotational sensors, airflow sensors, etc. The output signals 1056 may control engine operating parameters, transmission operating parameters, suspension parameters, etc.

The power supply 1048 provides power to the components of the vehicle 1046. The vehicle control system 1047 may store data in memory 1049 and/or the storage device 1050. Memory 1049 may include random access memory (RAM) and/or nonvolatile memory. Nonvolatile memory may include any suitable type of semiconductor or solid-state memory, such as flash memory (including NAND and NOR flash memory), phase change memory, magnetic RAM, and multi-state memory, in which each memory cell has more than two states. The storage device 1050 may include an optical storage drive, such as a DVD drive, and/or a hard disk drive (HDD). The vehicle control system 1047 may communicate externally using the network interface 1052.

The audio interface 1051 may include a microphone and a speaker. The audio interface 1051 may also include an integrated adaptive jitter buffer and packet loss concealment module according to the principles of the present disclosure. VoIP packets may be received by the network interface 1052 and passed to the audio interface 1051. The integrated AJB/PLC module may decode audio data included in the VoIP packets and pass the data to the speaker.

Figure 18D:
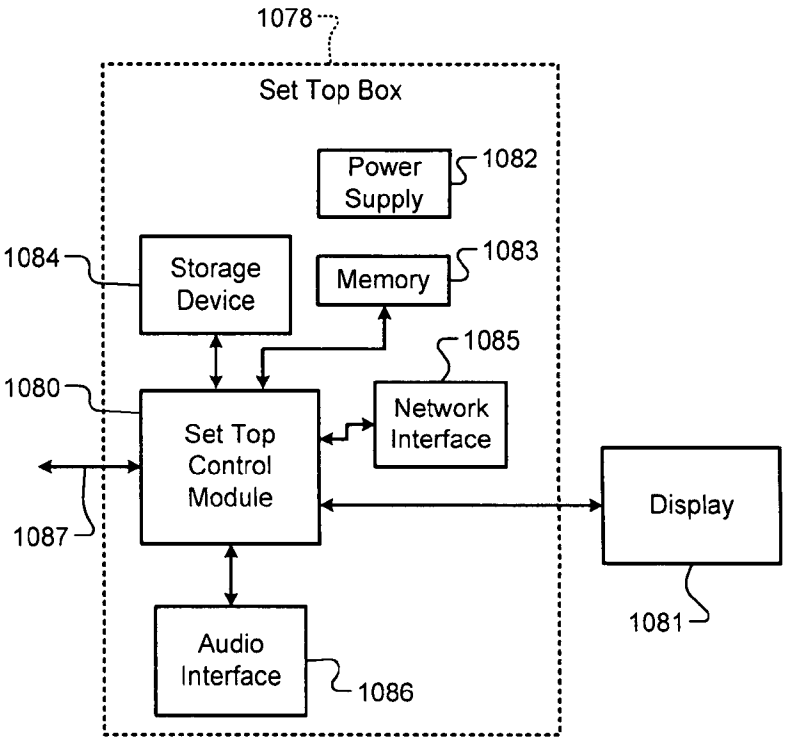
FIG. 18D is a functional block diagram of a set top box.
Figure 18C:
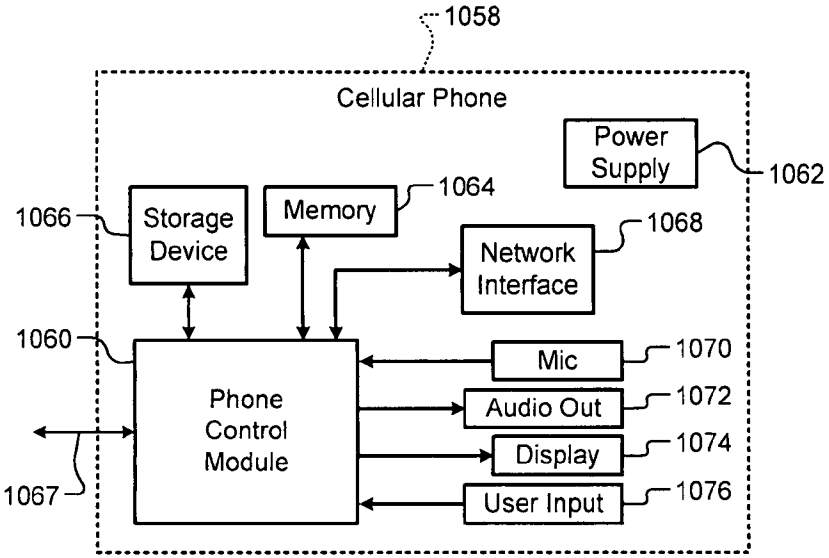
FIG. 18C is a functional block diagram of a cellular phone.

Referring now to FIG. 18C, the teachings of the disclosure can be implemented in a phone control module 1060 of a cellular phone 1058. The cellular phone 1058 includes the phone control module 1060, a power supply 1062, memory 1064, a storage device 1066, and a cellular network interface 1067. The cellular phone 1058 may include a network interface 1068, a microphone 1070, an audio output 1072 such as a speaker and/or output jack, a display 1074, and a user input device 1076 such as a keypad and/or pointing device. If the network interface 1068 includes a wireless local area network interface, an antenna (not shown) may be included.

The phone control module 1060 may receive input signals from the cellular network interface 1067, the network interface 1068, the microphone 1070, and/or the user input device 1076. The phone control module 1060 may process signals, including encoding, decoding, filtering, and/or formatting, and generate output signals. The output signals may be communicated to one or more of memory 1064, the storage device 1066, the cellular network interface 1067, the network interface 1068, and the audio output 1072.

Memory 1064 may include random access memory (RAM) and/or nonvolatile memory. Nonvolatile memory may include any suitable type of semiconductor or solid-state memory, such as flash memory (including NAND and NOR flash memory), phase change memory, magnetic RAM, and multi-state memory, in which each memory cell has more than two states. The storage device 1066 may include an optical storage drive, such as a DVD drive, and/or a hard disk drive (HDD). The power supply 1062 provides power to the components of the cellular phone 1058.

The phone control module 1060 may include an integrated adaptive jitter buffer and packet loss concealment module according to the principles of the present disclosure. VoIP packets may be received by the network interface 1068 and passed to the phone control module 1060. The integrated AJB/PLC module may decode audio data included in the VoIP packets and pass the decoded data to the audio output 1072.

Referring now to FIG. 18D, the teachings of the disclosure can be implemented in an audio interface 1086 of a set top box 1078. The set top box 1078 includes a set top control module 1080, a display 1081, a power supply 1082, memory 1083, a storage device 1084, and a network interface 1085. If the network interface 1085 includes a wireless local area network interface, an antenna (not shown) may be included.

The set top control module 1080 may receive input signals from the network interface 1085 and an external interface 1087, which can send and receive data via cable, broadband Internet, and/or satellite. The set top control module 1080 may process signals, including encoding, decoding, filtering, and/or formatting, and generate output signals. The output signals may include audio and/or video signals in standard and/or high definition formats. The output signals may be communicated to the network interface 1085 and/or to the display 1081. The display 1081 may include a television, a projector, and/or a monitor.

The power supply 1082 provides power to the components of the set top box 1078. Memory 1083 may include random access memory (RAM) and/or nonvolatile memory. Nonvolatile memory may include any suitable type of semiconductor or solid-state memory, such as flash memory (including NAND and NOR flash memory), phase change memory, magnetic RAM, and multi-state memory, in which each memory cell has more than two states. The storage device 1084 may include an optical storage drive, such as a DVD drive, and/or a hard disk drive (HDD).

The audio interface 1086 may include a microphone and a speaker. The audio interface 1086 may also include an integrated adaptive jitter buffer and packet loss concealment module according to the principles of the present disclosure. VoIP packets may be received by the network interface 1085 and passed to the audio interface 1086. The integrated AJB/PLC module may decode audio data included in the VoIP packets and pass the data to the speaker.

Figure 18E:
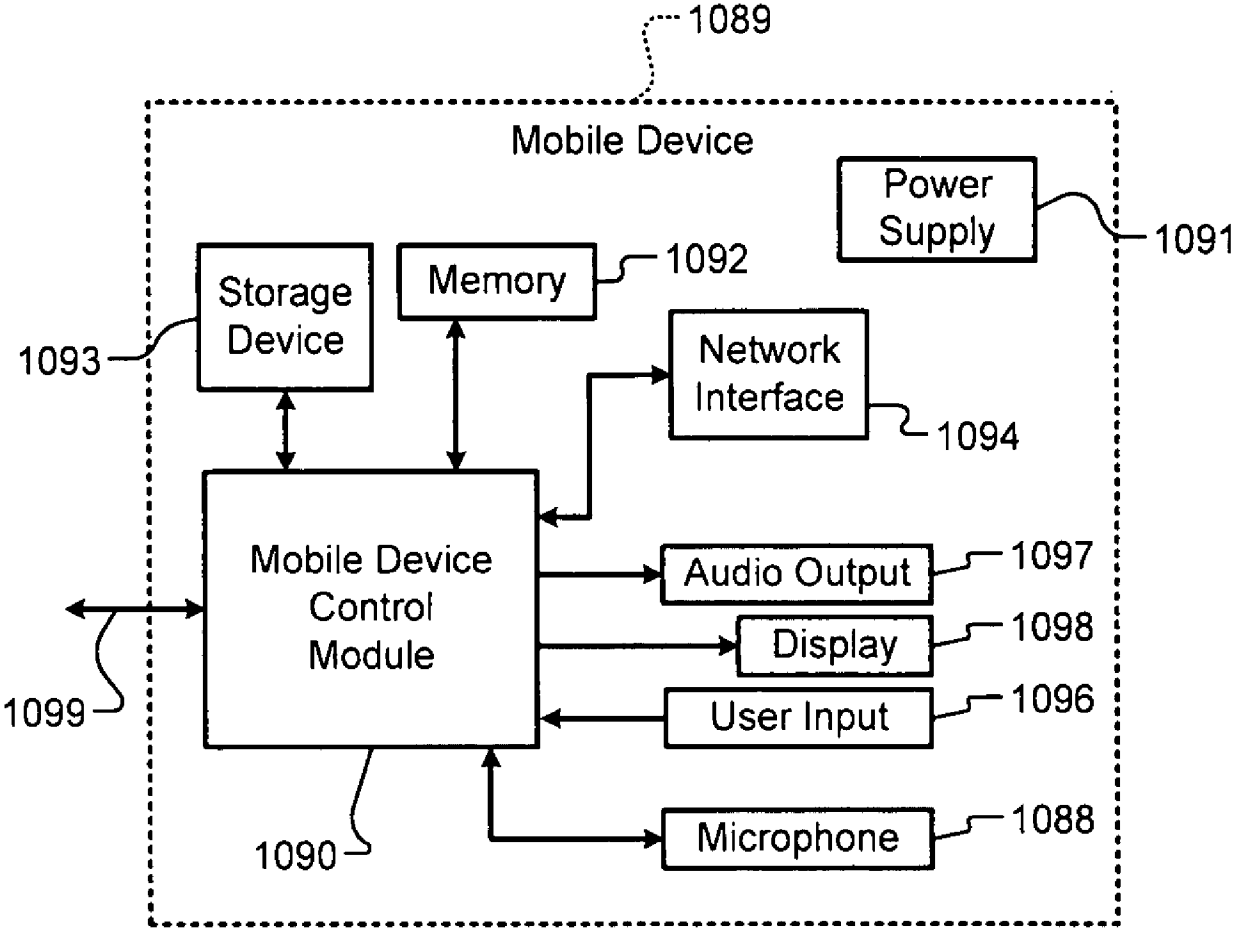
FIG. 18E is a functional block diagram of a mobile device.

Referring now to FIG. 18E, the teachings of the disclosure can be implemented in a mobile device control module 1090 of a mobile device 1089. The mobile device 1089 may include the mobile device control module 1090, a power supply 1091, memory 1092, a storage device 1093, a network interface 1094, and an external interface 1099. If the network interface 1094 includes a wireless local area network interface, an antenna (not shown) may be included.

The mobile device control module 1090 may receive input signals from the network interface 1094 and/or the external interface 1099. The external interface 1099 may include USB, infrared, and/or Ethernet. The input signals may include compressed audio and/or video, and may be compliant with the MP3 format. Additionally, the mobile device control module 1090 may receive input from a user input 1096 such as a keypad, touchpad, or individual buttons, and/or from a microphone 1088. The mobile device control module 1090 may process input signals, including encoding, decoding, filtering, and/or formatting, and generate output signals.

The mobile device control module 1090 may output audio signals to an audio output 1097 and video signals to a display 1098. The audio output 1097 may include a speaker and/or an output jack. The display 1098 may present a graphical user interface, which may include menus, icons, etc. The power supply 1091 provides power to the components of the mobile device 1089. Memory 1092 may include random access memory (RAM) and/or nonvolatile memory.

Nonvolatile memory may include any suitable type of semiconductor or solid-state memory, such as flash memory (including NAND and NOR flash memory), phase change memory, magnetic RAM, and multi-state memory, in which each memory cell has more than two states. The storage device 1093 may include an optical storage drive, such as a DVD drive, and/or a hard disk drive (HDD). The mobile device may include a personal digital assistant, a media player, a laptop computer, a gaming console, or other mobile computing device.

The mobile device control module 1090 may include an integrated adaptive jitter buffer and packet loss concealment module according to the principles of the present disclosure. VoIP packets may be received by the network interface 1094 and passed to the mobile device control module 1090. The integrated AJB/PLC module may decode audio data included in the VoIP packets and pass the decoded data to the audio output 1097.

Those skilled in the art can now appreciate from the foregoing description that the broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. A packet loss concealment system comprising:

a first buffer configured to store audio samples prior to a missing section of audio samples;

a second buffer configured to store audio samples subsequent to the missing section;

a forward propagation module configured to generate a forward propagated waveform by propagating a first waveform period that is based on the first buffer, wherein the forward propagation module is configured to increase periodicity of the first waveform period nonlinearly when propagating the first waveform period;

a backward propagation module configured to generate a backward propagated waveform by propagating a second waveform period that is based on the second buffer; and a ratio control module configured to selectively determine a ratio between a first periodicity of the audio samples in the second buffer and a second periodicity of the audio samples in the first buffer, wherein the forward propagation module is further configured to selectively propagate the first waveform period using the ratio, and wherein the backward propagation module is further configured to selectively propagate the second waveform period using an inverse of the ratio.

2. The packet loss concealment system of claim 1, wherein the forward propagation module is configured to increase periodicity of the first waveform period approximately exponentially when propagating the first waveform period.

3. The packet loss concealment system of claim 2, wherein the forward propagation module is configured to increase periodicity of the first waveform period according to a second-order function of sample number.

4. The packet loss concealment system of claim 3, wherein the second-order function has a second-order coefficient that is based on a difference between the first and second periodicities.

5. The packet loss concealment system of claim 4, wherein the second-order coefficient is based on a first quantity divided by twice a second quantity, wherein the first quantity comprises the difference, and the second quantity comprises a sum of a square of the second periodicity and twice a product of the second periodicity and a gap length, wherein the gap length is a length in samples of the missing section.

6. The packet loss concealment system of claim 5, wherein the second-order function has a first-order coefficient of one and a zero-order coefficient of zero.

7. The packet loss concealment system of claim 1, further comprising a comparison module configured to (i) compare the second waveform period to the forward propagated waveform and (ii) output a similarity signal.

8. The packet loss concealment system of claim 7, wherein the similarity signal comprises a correlation coefficient between the second waveform period and the forward propagated waveform.

9. The packet loss concealment system of claim 7, wherein the ratio control module is configured to (i) serially provide a plurality of ratios to the forward propagation module and (ii) choose one of the plurality of ratios that results in a greatest similarity signal from the comparison module.

10. The packet loss concealment system of claim 9, wherein the ratio control module is configured to selectively provide the one of plurality of ratios to the forward and backward propagation modules.

11. The packet loss concealment system of claim 10, wherein the ratio control module is configured to provide a ratio of 1 to the forward and backward propagation modules when the similarity signal is less than a threshold.

12. The packet loss concealment system of claim 1, further comprising a first repeatable period module that determines the first periodicity and that generates the first waveform period based on a first group of audio samples in the first buffer having a length equal to the first periodicity.

13. The packet loss concealment system of claim 12, wherein the first repeatable period module is configured to determine the first periodicity by determining a level of periodicity of the first buffer for each of a plurality of test periods and selecting one of the plurality of test periods whose level of periodicity is highest.

14. The packet loss concealment system of claim 13, wherein the first repeatable period module is configured to determine the level of periodicity corresponding to a first one of the plurality of test periods by performing a correlation between a first section of the first buffer and a second section of the first buffer, wherein the first and second sections are adjacent and have lengths equal to the first one of the plurality of test periods.

15. The packet loss concealment system of claim 12, wherein the first repeatable period module is configured to combine a second group of the audio samples in the first buffer with ones of the first group of audio samples, wherein the first and second groups are adjacent, and wherein the ones of the first group of audio samples are located in the first group on an end opposite to the second group.

16. The packet loss concealment system of claim 15 wherein a length of the second group is a predetermined length.

17. The packet loss concealment system of claim 15, wherein a length of the second group is proportional to the first periodicity.

18. The packet loss concealment system of claim 15, wherein the first repeatable period module is configured to add a product of the first group and a first windowing function to a product of the second group and a second windowing function.

19. The packet loss concealment system of claim 1, further comprising a blending module configured to selectively fill the missing section by combining a forward waveform based on the forward propagated waveform and a backward waveform based on the backward propagated waveform.

20. The packet loss concealment system of claim 19, wherein the forward waveform comprises at least part of the forward propagated waveform when the first buffer comprises voice data.

21. The packet loss concealment system of claim 20, wherein the first buffer comprises voice data when a rate of zero crossings of the audio samples in the first buffer is less than a crossing threshold.

22. The packet loss concealment system of claim 20, wherein the forward waveform comprises filler samples when the first buffer comprises other than voice data, wherein the filler samples comprise at least one of silent samples and white noise samples.

23. The packet loss concealment system of claim 19, wherein the backward waveform comprises at least part of the backward propagated waveform when the second buffer comprises voice data.

24. The packet loss concealment system of claim 23, wherein the second buffer comprises voice data when a rate of zero crossings of the audio samples in the second buffer is less than a crossing threshold.

25. The packet loss concealment system of claim 23, wherein the backward waveform comprises filler samples when the second buffer comprises other than voice data, wherein the filler samples comprise one of silent samples and white noise samples.

26. A method of controlling a packet loss concealment system, the method comprising:

storing audio samples prior to a missing section of audio samples;

storing audio samples subsequent to the missing section;

generating a forward propagated waveform by propagating a first waveform period that is based on the prior audio samples;

increasing periodicity of the first waveform period nonlinearly when propagating the first waveform period;

generating a backward propagated waveform by propagating a second waveform period that is based on the subsequent audio samples;

selectively determining a ratio between a first periodicity of the subsequent audio samples and a second periodicity of the prior audio samples;

selectively propagating the first waveform period using the ratio; and propagating the second waveform period using an inverse of the ratio.

27. The method of claim 26, further comprising increasing periodicity of the first waveform period approximately exponentially when propagating the first waveform period.

28. The method of claim 27 further comprising increasing periodicity of the first waveform period according to a second-order function of sample number.

29. The method of claim 28, wherein the second-order function has a second-order coefficient that is based on a difference between the first and second periodicities.

30. The method of claim 29, wherein the second-order coefficient is based on a first quantity divided by twice a second quantity, wherein the first quantity comprises the difference, and the second quantity comprises a sum of a square of the second periodicity and twice a product of the second periodicity and a gap length, wherein the gap length is a length in samples of the missing section.

31. The method of claim 30, wherein the second-order function has a first-order coefficient of one and a zero-order coefficient of zero.

32. The method of claim 26, further comprising comparing the second waveform period to the forward propagated waveform and outputting a similarity signal.

33. The method of claim 32, wherein the similarity signal comprises a correlation coefficient between the second waveform period and the forward propagated waveform.

34. The method of claim 32, further comprising:

repeatedly performing the forward propagating using a plurality of ratios; and choosing one of the plurality of ratios that results in a greatest similarity signal.

35. The method of claim 34, further comprising performing the forward and backward propagating using the one of the plurality of ratios.

36. The method of claim 35 further comprising performing the forward and backward propagating using a ratio of 1 when the greatest similarity signal is less than a threshold.

37. The method of claim 26, further comprising:

determining the first periodicity; and generating the first waveform period based on a first group of the prior audio samples having a length equal to the first periodicity.

38. The method of claim 37, further comprising determining the first periodicity by:

determining a level of periodicity of the prior audio samples for each of a plurality of test periods; and selecting one of the plurality of test periods whose level of periodicity is highest.

39. The method of claim 38, further comprising determining the level of periodicity corresponding to a first one of the plurality of test periods by performing a correlation between a first section of the prior audio samples and a second section of the prior audio samples, wherein the first and second sections are adjacent and have lengths equal to the first one of the plurality of test periods.

40. The method of claim 37, further comprising combining a second group of the prior audio samples with ones of the first group of audio samples, wherein the first and second groups are adjacent, and wherein the ones of the first group of audio samples are located in the first group on an end opposite to the second group.

41. The method of claim 40, wherein a length of the second group is a predetermined length.

42. The method of claim 40, wherein a length of the second group is proportional to the first periodicity.

43. The method of claim 40 further comprising adding a product of the first group and a first windowing function to a product of the second group and a second windowing function.

44. The method of claim 26, further comprising selectively filling the missing section by combining a forward waveform based on the forward propagated waveform and a backward waveform based on the backward propagated waveform.

45. The method of claim 44, wherein the forward waveform comprises at least part of the forward propagated waveform when the prior audio samples comprise voice data.

46. The method of claim 45 wherein the prior audio samples comprise voice data when a rate of zero crossings of the prior audio samples is less than a crossing threshold.

47. The method of claim 45, wherein the forward waveform comprises filler samples when the prior audio samples comprise other than voice data, wherein the filler samples comprise at least one of silent samples and white noise samples.

48. The method of claim 44, wherein the backward waveform comprises at least part of the backward propagated waveform when the subsequent audio samples comprise voice data.

49. The method of claim 48, wherein the subsequent audio samples comprise voice data when a rate of zero crossings of the subsequent audio samples is less than a crossing threshold.

50. The method of claim 48, wherein the backward waveform comprises filler samples when the subsequent audio samples comprise other than voice data, wherein the filler samples comprise one of silent samples and white noise samples.

* * * * *